US011365540B2

(12) United States Patent
Wheeler et al.

(10) Patent No.: US 11,365,540 B2
(45) Date of Patent: Jun. 21, 2022

(54) FUNCTIONAL MODULAR BUILDING CARTRIDGES AND METHODS

(71) Applicant: VIRGINIA TECH INTELLECTUAL PROPERTIES, INC., Blacksburg, VA (US)

(72) Inventors: Joseph Wheeler, Blacksburg, VA (US); Robert Vance, Blacksburg, VA (US)

(73) Assignee: VIRGINIA TECH INTELLECTUAL PEOPERTIES, INC., Blacksburg, VA (US)

( * ) Notice: Subject to any disclaimer, the term of this patent is extended or adjusted under 35 U.S.C. 154(b) by 118 days.

(21) Appl. No.: 17/004,238

(22) Filed: Aug. 27, 2020

(65) Prior Publication Data

US 2021/0079645 A1 Mar. 18, 2021

Related U.S. Application Data

(60) Provisional application No. 62/892,055, filed on Aug. 27, 2019.

(51) Int. Cl.
*E04B 1/348* (2006.01)
*E04B 1/344* (2006.01)

(52) U.S. Cl.
CPC ..... *E04B 1/34861* (2013.01); *E04B 1/344* (2013.01); *E04B 1/34869* (2013.01)

(58) Field of Classification Search
CPC .. E04B 1/34861; E04B 1/344; E04B 1/34869; E04B 1/34807
See application file for complete search history.

(56) References Cited

U.S. PATENT DOCUMENTS 3,721,056 A * 3/1973 Toan ..... E04H 1/04 52/79.12
3,750,366 A * 8/1973 Rich, Jr. ..... E04B 1/34807 52/79.8
3,866,672 A * 2/1975 Rich, Jr. ..... F24F 3/044 165/50
5,381,633 A * 1/1995 Hendrich ..... E04B 1/34807 52/745.11
2007/0144079 A1* 6/2007 Hourihan ..... E04B 1/34807 52/79.1
2009/0019811 A1* 1/2009 Goldman ..... E04B 1/34807 52/741.1
2016/0040443 A1* 2/2016 Stephenson ..... E04H 1/005 52/79.5

(Continued)

*Primary Examiner* — Gisele D Ford
(74) *Attorney, Agent, or Firm* — Thomas|Horstemeyer, LLP

(57) ABSTRACT

Disclosed are various embodiments of a modular building structure including modular cartridges. In one example, a modular residential structure comprises a systems cartridge that is configured to provide a number of services for the modular residential structure. A spine cartridge is configured to be attached to a top of or a bottom of the systems cartridge. The spine cartridge comprises conduits for conveying the services from the systems cartridge to a number of access points. A planar wall can be configured to form a portion of the modular residential structure. The systems cartridge, the planar wall, and the spine cartridge can be prefabricated at an off-site location. The systems cartridge can be attached to the spine cartridge at an on-site location.

20 Claims, 21 Drawing Sheets

(56) References Cited

U.S. PATENT DOCUMENTS

| | | | | |
|---|---|---|---|---|
| 2016/0122997 | A1* | 5/2016 | Smith | E04H 3/02 52/79.12 |
| 2016/0312485 | A1* | 10/2016 | Wilson | E04B 1/34807 |
| 2017/0002579 | A1* | 1/2017 | French | E04B 1/34807 |
| 2018/0035625 | A1* | 2/2018 | Lindbo | B65G 1/0464 |
| 2019/0119903 | A1* | 4/2019 | Rebeil | E04B 1/34352 |
| 2019/0145118 | A1* | 5/2019 | Gauthier | E04H 1/005 52/79.1 |
| 2020/0040565 | A1* | 2/2020 | Viehweg | E04B 1/34815 |
| 2020/0095758 | A1* | 3/2020 | Wong | E04B 1/34807 |
| 2021/0324644 | A1* | 10/2021 | Dicks | E04H 1/02 |
| 2021/0363747 | A1* | 11/2021 | Leclerc | A47B 77/08 |
| 2021/0388604 | A1* | 12/2021 | Briggs | E04H 1/04 |

* cited by examiner

FUNCTIONAL MODULAR BUILDING CARTRIDGES AND METHODS

CROSS REFERENCE TO RELATED APPLICATIONS

This application claims the benefit of, and priority to, co-pending U.S. Provisional Patent Application No. 62/892,055 entitled "FUNCTIONAL MODULAR HOME CARTRIDGES AND METHODS," filed on Aug. 27, 2019, which is incorporated herein by reference in its entirety.

BACKGROUND

Modular residential housing structures, such as mobile homes, can be constructed at a factory and then transported to a location for a homeowner. In the case of mobile homes, these modular residential housing structures can be constructed for different sizes, such as a single-wide, a double-wide, or a triple-wide. However, even the smallest mobile homes are difficult to transport on most roads.

BRIEF DESCRIPTION OF THE DRAWINGS

Many aspects of the present disclosure can be better understood with reference to the following drawings. The components in the drawings are not necessarily to scale, with emphasis instead being placed upon clearly illustrating the principles of the disclosure. Moreover, in the drawings, like reference numerals designate corresponding parts throughout the several views.

DETAILED DESCRIPTION

The embodiments of the present disclosure relate to a modular building structure that can be assembled on site with a plurality of prefabricated volumetric components. For example, the present disclosure involves a module building structure comprised of prefabricated volumetric components, "smart pods," or "cartridges" that can be individually pre-plumbed, pre-wired, pre-ducted, pre-furnished and/or prefinished in an off-site facility. As such, assembling the modular building structure can be performed on site because the interconnections between components is simple and fast. As "plug and play" modules, the prefabricated components or cartridges can include elements such as lighting, ductwork, electrical, and electronics that connect to form a whole functional system when the components are installed. The prefabricated components can include a floor structure, finishes, and preinstalled plug and play heating/cooling systems. Over time, one or more particular prefabricated components of the modular building structure can be replaced with updated components.

Figure 1A:
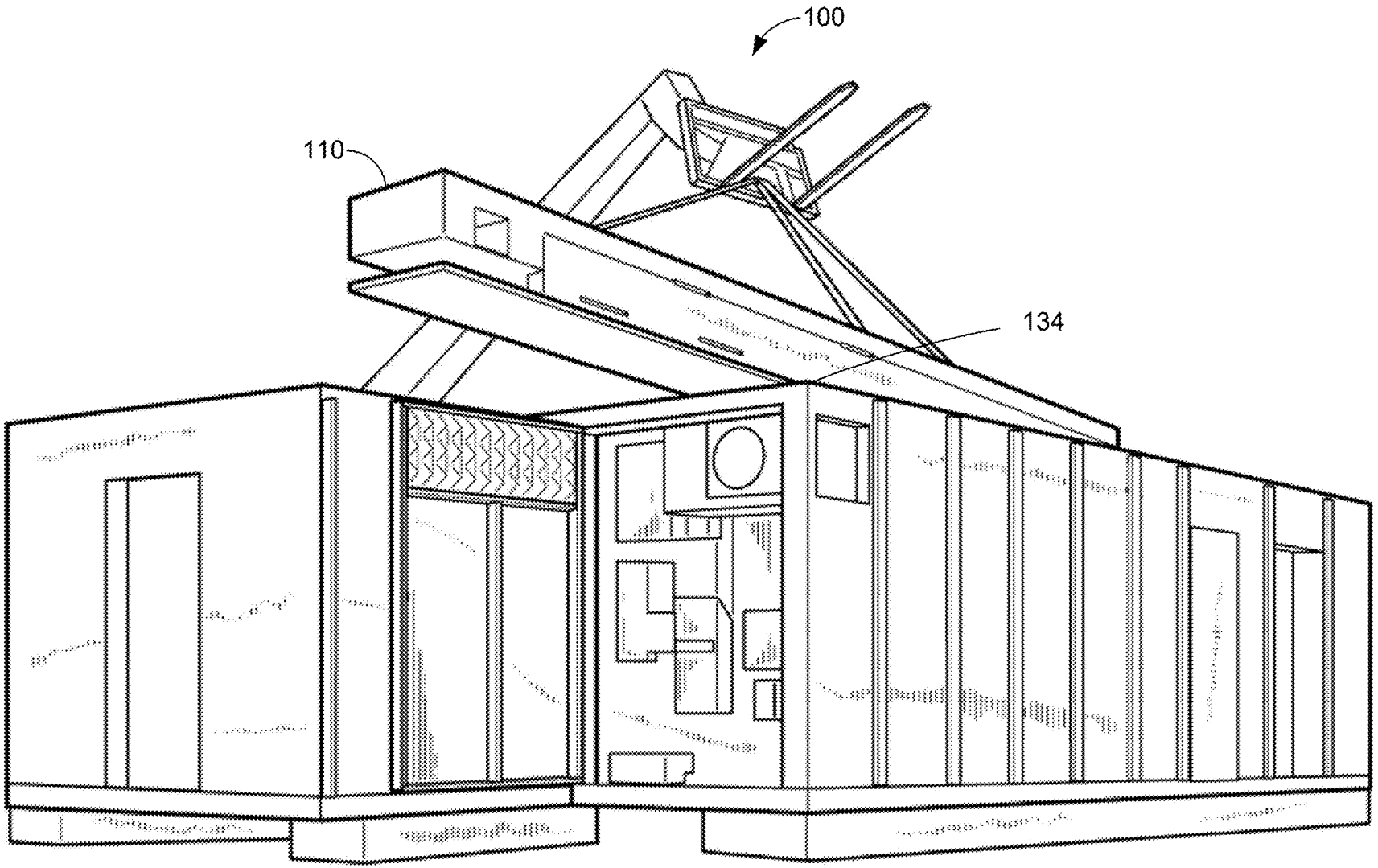
FIG. 1A is drawing of a modular home being assembled, according to one embodiment described herein.
Figure 1B:
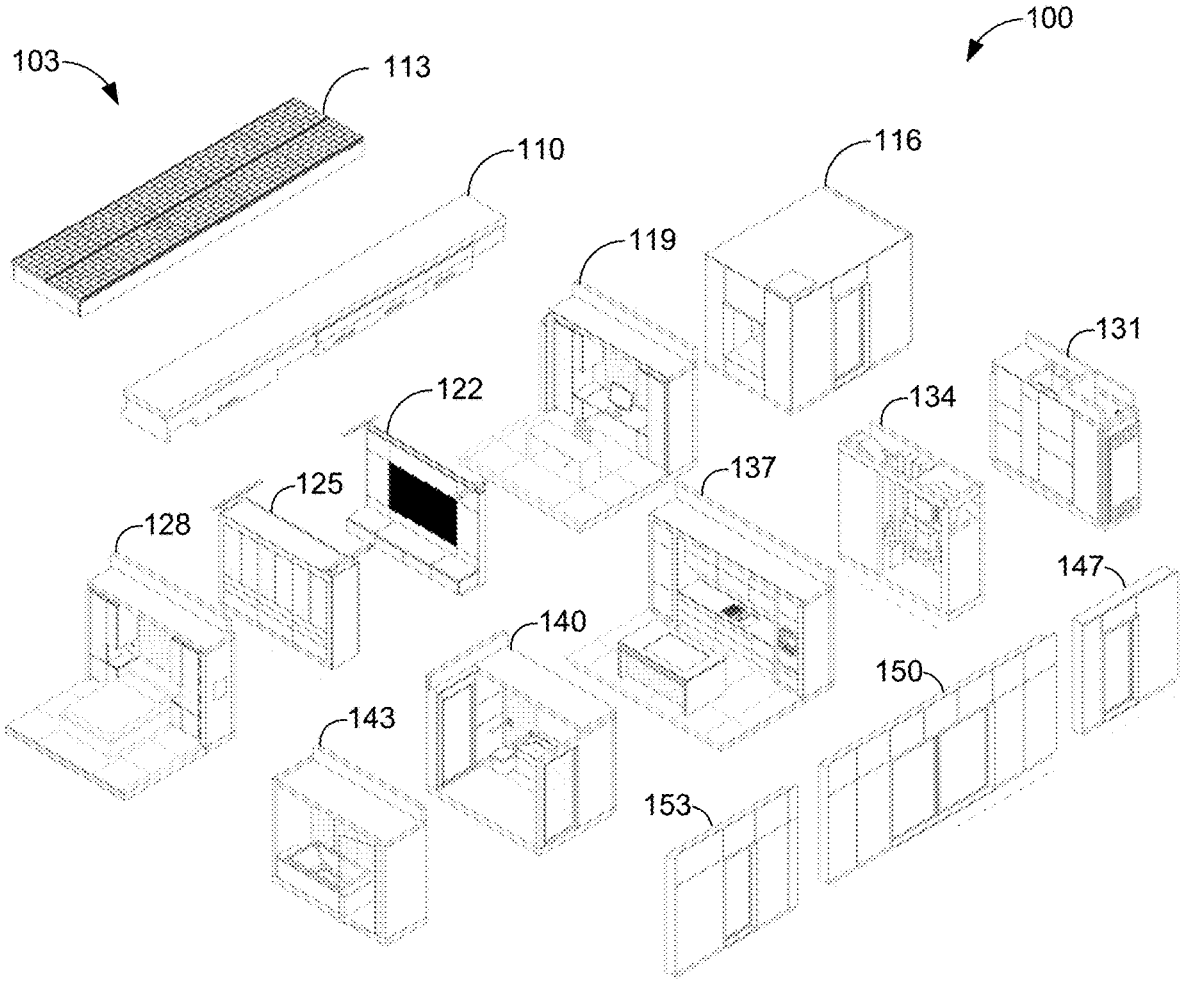
FIG. 1B is an exploded view of different cartridges from FIG. 1A, according to one embodiment described herein.
Figure 1B:
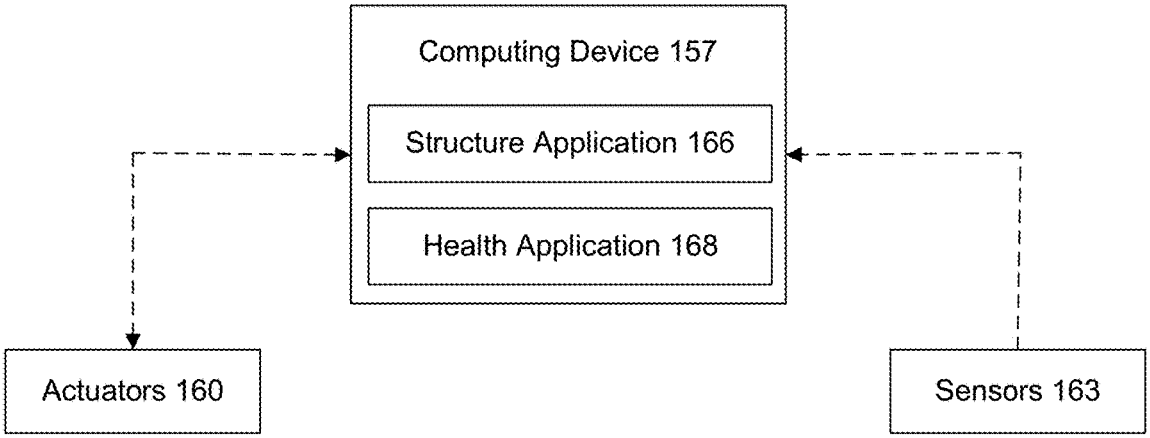

With reference to FIGS. 1A and 1B, shown is a drawing of a modular building structure 100 being assembled. FIG. 1B is an exploded view of different cartridges 103 in the modular building structure 100, in which some cartridges 103 are depicted in FIG. 1A and others are omitted from view in FIG. 1A. As a non-limiting example, the modular building structure 100 in FIG. 1A is being assembled as a residential housing structure, but the cartridges 103 can be assembled as commercial, retail, and other types of spaces.

The modular building structure 100 can include a spine cartridge 110, a solar power cartridge 113, an entry cartridge 116, an office cartridge 119, a media cartridge 122, a closet cartridge 125, a bedroom cartridge 128, a plumbing cartridge 131, a systems cartridge 134, a kitchen cartridge 137, a first bathroom cartridge 140, a second bathroom cartridge 143, an exit door cartridge 147, a living room door cartridge 150, a bedroom door cartridge 153, and other suitable cartridges for commercial and/or residential structures (collectively "the cartridges 103").

Additionally, the modular building structure 100 may include other components for manipulating the interior environment of the modular building structure 100 and for manipulating aspects of the exterior environment of the modular building structure 100. For example, the modular building structure 100 can also include a computing device 157, actuators 160, sensors 163, and other suitable components. The actuators 160 can be embodied as motors, rails, guides, and other suitable components. The sensors 163 can be embodied as sensors used for determining position and status of a structural component, as one example. The sensors 163 can also be embodied as cameras, motion sensors, and other suitable devices for detecting the movement of occupants in the modular building structure 100.

The computing device 157 may comprise, for example, a processor-based system such as a computer system. Such a computer system may be embodied in the form of a desktop computer, a laptop computer, personal digital assistants, cellular telephones, smartphones, set-top boxes, music players, web pads, tablet computer systems, game consoles, electronic book readers, or other devices with like capability. The computing device 157 may include a display. The display may comprise, for example, one or more devices such as liquid crystal display (LCD) displays, gas plasma-based flat panel displays, organic light emitting diode (OLED) displays, electrophoretic ink (E ink) displays, LCD projectors, or other types of display devices, etc.

The computing device 157 can also represent a server computer that is located off-site. In this context, the computing device 157 may be representative of an arrangement of, for example, one or more server banks or computer banks or other arrangements. Such computing devices may be located in a single installation or may be distributed among many different geographical locations. For example, the computing device 157 can be representative of a computing environment that includes a plurality of computing devices that together may comprise a hosted computing resource, a grid computing resource, and/or any other distributed computing arrangement.

The computing device 157 may be configured to execute various applications such as a structure application 166, a health application 168, and/or other applications. The structure application 166 can be executed to provide a user interface for a user to the control the operations of the cartridges 103. For example, the structure application 166 may be used to move the physical location of the closet cartridge 125 from a substantially center area of the modular building structure 100 to a side of the modular building structure 100, which the closet cartridge 125 is moved by controlling the actuator 160. The structure application 166 also can use the actuator 160 to move cartridges 103 and/or furniture in the modular building structure 100. The structure application 166 can be used to control the operations of the media being played on different devices, the security systems, the energy harvesting systems (e.g. the solar power cartridge 113, lighting system, and other suitable building operations. As such, the structure application 166 can operate a central control interface for the modular building structure 100.

The health application 168 can be executed to monitor the health of individuals in the modular building structure 100. For example, the health application 168 can monitor the vital signs of occupants and detect any indications of health-concerning events (e.g., slips, falls, heart attacks, vocal calls for help, etc.).

The structure application 166, health application 168, and other client applications may be executed in the computing device 157, for example, to access network content served up by a remote computing device/or other servers, thereby rendering a user interface on the display. To this end, the structure application 166 and health application 168 may comprise, for example, a browser, a dedicated application, or other related applications, and the user interface may comprise a network page, an application screen, etc.

Unlike prefabricated panelized wall assemblies that usually deploy to provide the building envelope (e.g., insulation, doors, windows, electrical and structure), the embodiments of the present disclosure involve volumetric housing components that are "plug and play" "cartridges" allowing one to completely install fully functional, pre-inspected, with building components in a short time period requiring little on-site skilled labor (e.g., skilled personnel for heating, ventilation, and air conditioning (HVAC) systems and ductwork, plumbing systems, electrical systems, electronics, cabinetry, cabinetry hardware, finished millwork, etc.). The system is designed so that all modular components can be delivered to a site and installed/anchored on a permanent foundation.

The modular components of the embodiments are sized to allow them to nest together easily. Interconnecting electronics and plumbing are consolidated to localized areas in order to allow for simple plug and play hookup. Electrical subpanels can be located on individual cartridges in order to consolidate all circuits within a particular cartridge. One home run can connect the electrical subpanel to the home run line and to the main breaker panel of the house, for example through the spine cartridge as will be described with respect to at least FIG. 1A.

Floors (structural or nonstructural) when folded up can provide protection/enclosure for the cartridge(s) 103 during shipment to the building site. When the cartridge 103 is set into place on site, the floor panel can be folded down to become the subfloor/floor structure. In many cases, most floors can be transported via cartridges 103.

Insulated ceiling components (also sized in 8' widths for shipping purposes) can also be preassembled and prewired with lighting systems, waterproof membranes, and other features. Unlike manufactured homes that require oversized big-box modular components and wide load transportation permits, the embodiments of the present disclosure can use module sizes within legal maximum transportation widths and heights (e.g., a width of 8'6" and a height of 8', 10', 12', or 13' depending on the trailer type). As such, the embodiments are less costly to transport to a build site. Thus, the embodiments enable greater flexibility with the space planning of the home and provide more options for the appearance of the residence. As a result, modular residences are not limited to the traditional "trailer" look and feel of big-box modular homes, which means a homeowner is not limited to the traditional "trailer" proportions.

The embodiments of the present disclosure can also be used for medium and high density housing, senior care facilities and hospitals (where telemedical and monitoring technologies can be incorporated), hotels, office buildings, and many other building types. The modular units can be structural (i.e., load bearing) or just interior based (i.e., non-load bearing), which effects panel thickness and required structure.

In the context of the present disclosure, "plug-and-play" can refer to a method to quickly attach electronic, electric, plumbing, and HVAC systems from one cartridge unit to its home connection. Electrical connections can be quickly made with commercially-available and electrical-code-approved male/female plugs and other suitable connectors. Electronic connections can be made with ethernet hubs, or couplings for data connections. Plumbing connections can be made with code approved methods to join piping supply lines, such as SharkBite® connectors, polyvinyl chloride (PVC) glue connections or mechanical couplers, simple copper sweating in place, or other types of suitable plumbing connectors. Main trunk lines for HVAC ducts can be mechanically connected with mechanical connection flanges where two cartridges align with each other (e.g., spine cartridge and mechanical cartridge).

In each cartridge 103, the number of connections can be minimized and consolidated to one easily accessible location per cartridge unit. For example, each cartridge may have an access panel that consolidates all of the connections. Further, the interior access panel can be removable and allow for easy access to connections, often required by code. The access panel can connect to the spine cartridge 110.

The embodiments have several advantages as compared to existing modular structures. For example, the embodiments are distinguished from large volume modules (e.g., manufactured homes or double-wide houses). Manufactured homes are usually oversized for shipping and limit finished interior space once assembled.

The embodiments include a network of interconnecting pods that nest together to create a fully functional building system or enclosure. For example, the modular components, such as a room, a portion of a room, a wall, and other aspects, can be prefabricated with electrical lines, plumbing connections, finishes, electronic systems, Internet networking systems, air ducts, HVAC systems, electrical panels, and other suitable building components. As such, many embodiments can provide more than an exterior shell or an enclosure of the house. Since the modular components are prefabricated with various systems, connections, and other components, the building structure can be assembled in less time than a traditional house, because less skilled labor is needed to install the various components on site.

Another advantage of the embodiments of the present disclosure is that all of the modular components can be constructed for legal shipping size. All components needed to install the working home come in easily shippable cartridge forms. For example, some modular components can be transported on a drop deck flatbed trailer if the modular components are within 10 feet high×8½ feet wide. In another example, some modular components can be transported on a standard flatbed trailer if the modular components are within 8 feet high×8½ feet wide. In another example, some modular components can be transported on a double drop flatbed trailer if the modular components are within 12 feet high×8½ feet wide. In some embodiments, the height of the cartridges 103 can be less than about thirteen feet and the width of the cartridges 103 can be less than about nine feet.

Next, a method of assembling the modular building structure 100 is provided. Initially, the cartridges 103 can be prefabricated at an off-site location. The cartridges 103 can be structurally assembled and equipped with different fixtures, furniture, applications, and other suitable components. For example, the cartridges 103 can be pre-plumbed with plumbing conduits, pre-wired for electrical conduits, prefitted with air duct conduits, pre-wired for data communication conduits, and other suitable conduits.

Then, a person can select a set of the cartridges 103 to be assembled as a home. The selection process may involve considering size constraints for the onsite location, personal preferences for a home, and other factors. A particular arrangement or floor plan can be designed for the selected cartridges 103. The selected cartridges 103 can be delivered to the on-site location. As noted earlier, the cartridges 103 can be constructed in smaller dimensions than previous designs in order for smaller trailers to be able to transport the selected cartridges 103 to the on-site location. For example, the selected cartridges 103 have a width of less than nine feet and a height of less than thirteen feet. At the on-site location, a foundation may be prepared for the placement of the cartridges 103.

Next, construction equipment (e.g. a crane or a shooting boom forklift as shown in FIG. 1A) can be used for assembling the cartridges 103 together according to the floor plan. In some scenarios, the cartridges 103 may need to be assembled in a particular order or sequence. For example, a systems cartridge can be placed on a residential foundation. The systems cartridge 134 can be configured to provide various services for the residential structure. The systems cartridge 134 may be strategically placed because it may need to be placed in close proximity to certain cartridges 103.

Then, a plumbing cartridge 131 can be placed near the systems cartridge 134. The plumbing cartridge 131 and the systems cartridge 134 may be placed in close proximity to the systems cartridge in order for the relevant connections of each cartridge 103 to be accessible to the corresponding connections in the spine cartridge 110.

Next, additional selected residential cartridges 103 can be placed on the residential foundation. The selected residential cartridges 103 can include some of the cartridges 103 depicted in FIG. 1B, such as a bedroom cartridge 128, a kitchen cartridge 137, bathroom cartridges 140/143, an entry cartridge 116, a closet cartridge 125, and other suitable cartridges 103.

Afterwards, the spine cartridge 110 can be positioned on top of a portion of the systems cartridge 134 and the plumbing cartridge 131. The operators assembling the residential structure may use the recessed perimeter areas 304 (FIG. 3A) of the spine cartridge 110 as a guide for placing the spine cartridge 110 on top of the systems cartridge 134. The spine cartridge 110 includes multiple conduits for conveying services from the systems cartridge 134, the plumbing cartridge 131, and other cartridges 103 to multiple access points in the residential structure. The conduits in the spine cartridge 110 can be connected to the appropriate connections on the systems cartridge 134 and the plumbing cartridge 131. Then, in some embodiments, the other selected cartridges 103 can be connected either directly or indirectly to the spine cartridge 110.

Alternatively, in some embodiments, the spine cartridge 110 may be placed on the floor or a subfloor of the residential structure. As such, the spine cartridge 110 may be placed on the on-site location prior to placing the systems cartridge 134, the plumbing cartridge 131, and other suitable cartridges 103. The cartridges 110 can be attached to each other with various fasteners.

Figure 2:
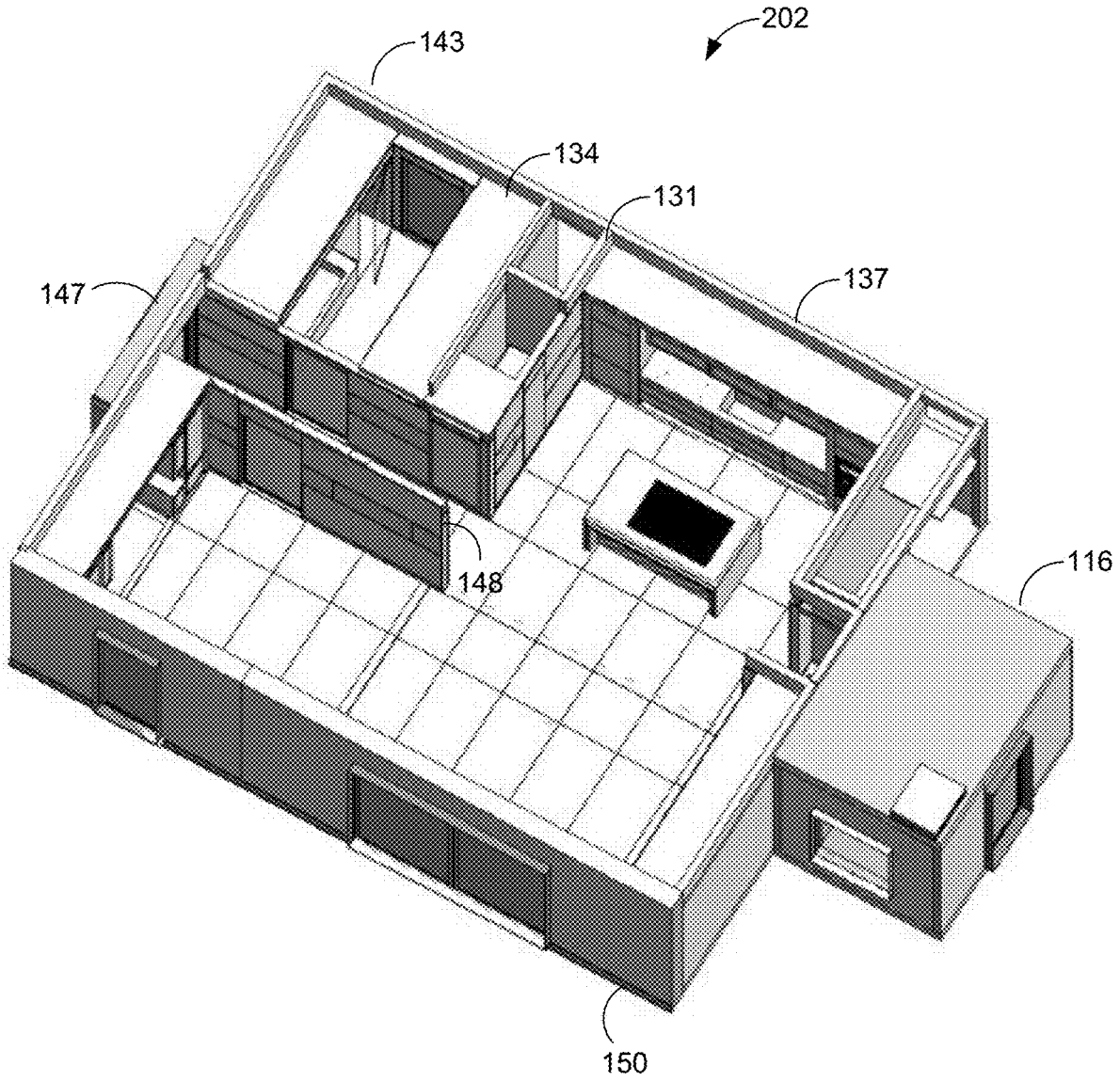
FIG. 2 is a drawing of an exemplary floor arrangement of the cartridges shown in FIG. 1B, according to one embodiment described herein.

With reference to FIG. 2, shown is a drawing of an exemplary floor arrangement 202 of a modular home comprised of cartridges from FIG. 1B. The floor arrangement 202 includes a systems cartridge 134, a plumbing cartridge 131, a second bathroom cartridge 143, an exit door cartridge 147, a kitchen cartridge 137, an entry cartridge 116, a plurality of planar prefabricated walls 148, a living room door cartridge 150, and other suitable components. It should be noted that the floor arrangement 202 differs from the modular building structure 100. Some of the cartridges 103 in the modular building structure 100 are omitted from the floor arrangement 202. Additionally, the cartridges in the floor arrangement 202 are configured to form a different floor layout than the one implemented in the modular building structure 100. As such, the embodiments of the cartridges 103 shown in FIG. 1B enable for various combinations of arrangements for building a modular residence or commercial structure.

In another embodiment, the modular building structure 100 can be built as a tiny home shelter or as a disaster relief Home. The modular building structure 100 can be constructed in this manner quickly in order to provide shelter as soon as possible. In this scenario, the number of the cartridges 103 can be minimized.

For example, beginning with a kitchen cartridge 137 and/or bathroom cartridges 140/143 as its internal core, walls and roofs can be deployed around this base structure to provide instant housing, fast to install with little to no skilled labor needed to deploy. All complex systems can be included in one compact assembly starting with the core that contains the pre-plumbed, prewired, pre-furnished and prefinished kitchen and/or bathroom. An HVAC unit can also be included. Prefabricated walls 148 can incorporate interior finishes and exterior siding as well as preinstalled doors and windows. Electrical outlets and circuits can also be preinstalled. Prefabricated roof assemblies can also deploy with roof membrane and ceiling finishes. Also, the modular building structure 100 can include options for renewable solar panel technology for electrical and hot water generation, and clerestory window systems. All panels can be insulated. The assembly can be installed with no onsite skilled labor necessary and with locally available, rentable forklift equipment. This shelter, with integrated structural walls can be stacked to double square footage or nest side by side. It can be configured for duplexes or single family.

The prefabricated walls 148 can come with either prefinished exterior siding or prefinished interior walls, leaving easy to install prefinished rain-screen panels or prefinished interior wall panels, or both. Multiple systems can be incorporated based on the need in the unit's final location. Roofs can incorporate photovoltaics for power, solar thermal for hot water or various water filtration systems for water purification (potable).

Figure 3A:
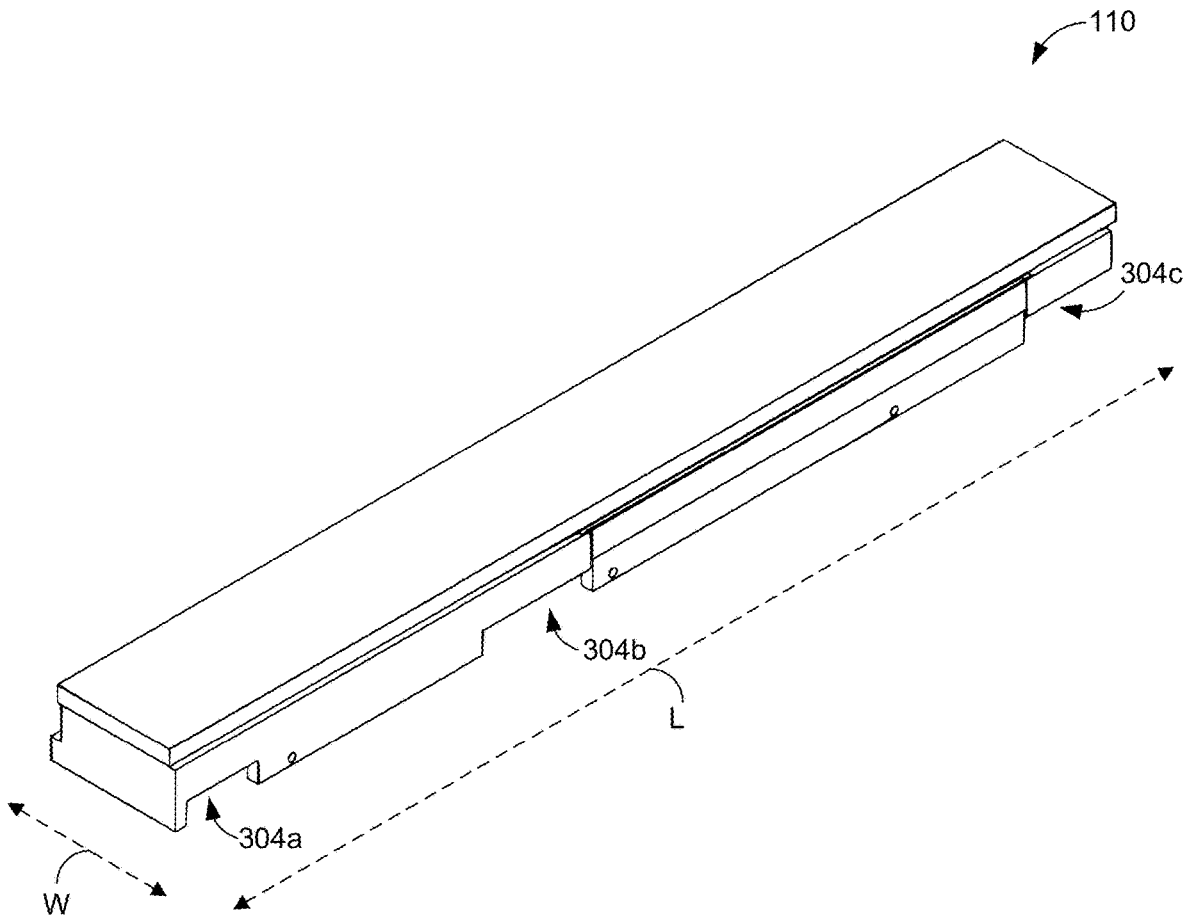
FIGS. 3A-3C illustrate different views of the spine cartridge shown in FIGS. 1A and 1B, according to one embodiment described herein.
Figure 3B:
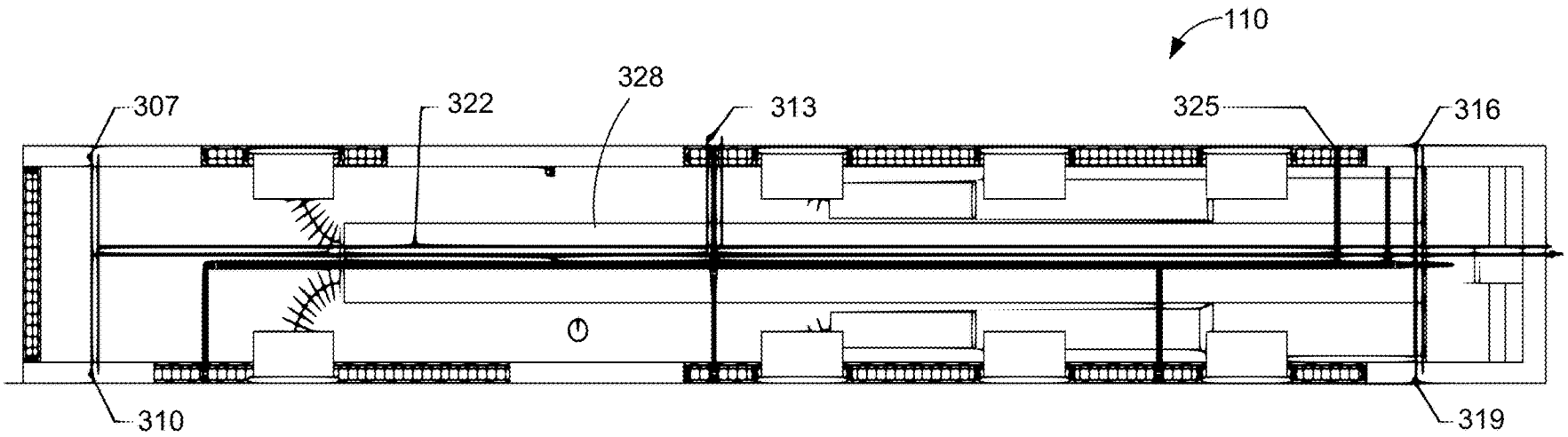
Figure 3C:
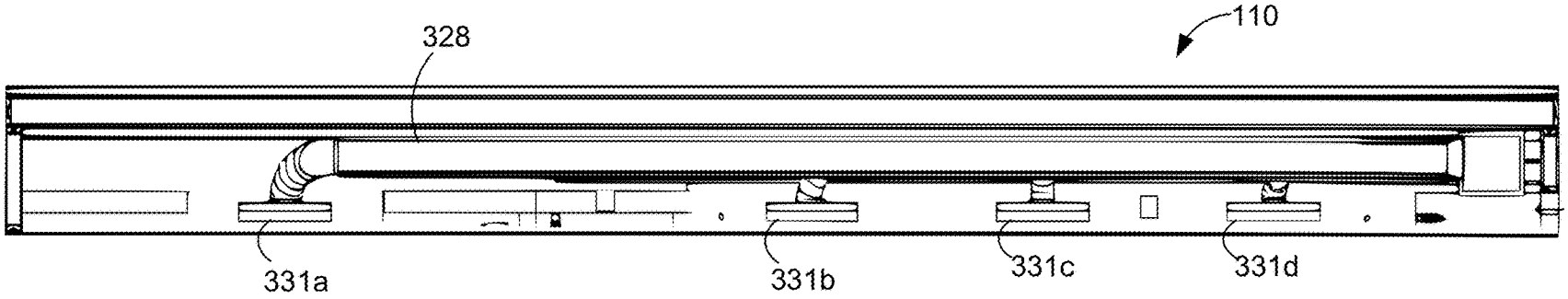

Next, with reference to FIGS. 3A through 3C, shown are various views of the spine cartridge 110 from FIGS. 1A and 1B. FIG. 3A illustrates a perspective view of the spine cartridge 110. FIG. 3B illustrates a bottom up view of the spine cartridge 110, and FIG. 3C illustrates a side view of the spine cartridge 110.

The spine cartridge 110 can serve as the spinal cord for the modular building structure 100 by delivering multiple services (e.g., electrical power, air conditioning, water supply, data communications, etc.) from the particular cartridge to other plug-and-play service cartridges 103 in the modular building structure 100 such as the kitchen cartridge 137, the office cartridge 119, the first bathroom cartridge 140, the bedroom cartridge 128, and other suitable cartridges and aspects of the modular building structure. The spine cartridge 110 can provide these services through plug and play components, in which the spine cartridge 110 can feed "home run" electrical lines, communication wiring and ductwork distribution. In other words, the spine cartridge 110 can include various conduits for providing services to different parts of the modular building structure. For example, the spine cartridge 110 may include an electrical conduit for providing power from the systems cartridge 134 to a plurality of electrical access points in the modular building structure 100, an air duct conduit for providing a flow of conditioned air from the systems cartridge 134 to a plurality of air duct access points in the modular building structure, and a plumbing conduit for providing the flow of water from the plumbing cartridge 131 to a plurality of plumbing access points in the modular building structure 100. In some examples, the spine cartridge 110 can be located in the ceiling or in a floor, typically above or below a hallway or circulation corridor for access to the network of room cartridges 103.

In other examples, the spine cartridge 134 can include air distribution conduits and air filtration components. The air filtration components can be used to filter particles down to 0.1 microns, which enables for the filtration of dust, allergens, and virus particles.

As shown in FIG. 3A, the spine cartridge 110 can have an elongated shape along its length L in relation to its width W. Additionally, along the length L, the spine cartridge 110 can have recessed perimeter areas 304*a-c* (collectively "recessed perimeter areas 304"). During the assembly of the modular building structure 100, the recessed perimeter areas 304 can be used to guide the placement of the spine cartridge 110 on top of the other cartridges 103.

In other embodiments, the spine cartridge 110 can be embedded into the floor or a subfloor. In this case, the recessed perimeter areas 304 can be used to guide the place of other cartridges 103 that are placed on top of the spine cartridge 110. For example, as shown in FIG. 1A, a boom forklift vehicle can raise the spine cartridge 110 above the modular building structure 100. As the boom forklift vehicle lowers the spine cartridge 110, the recessed perimeter areas 304 can help guide the placement on top of the correction location of the cartridge below.

Next, FIG. 3B illustrates a bottom-up view of the spine cartridge 110 in which different conduits and connections are shown. The spine cartridge 110 can include a first home run connection 307 to a bathroom subpanel, a second home run connection 310 to a bedroom subpanel, a third home run connection 313 to a plumbing subpanel, a fourth home run connection 316 to an electrical breaker panel in the systems cartridge 134, and a fifth home run connection 319 to an office subpanel (collectively "the home run connections"). The spine cartridge 110 can also include a wired network distribution line 322, a water distribution line 325, an air duct network 328, and other suitable components.

The home run connections are examples of an electrical conduit for providing power to each of the cartridges from the systems cartridge 134, in which the home run connections are connected to the electrical break panel in the systems cartridge 134. The wired network distribution line 322 can be a suitable network communication line, such as one or more ethernet cables. The wired network distribution line 322 can serve as a data communication conduit to different access points through the modular building structure 100. In some examples, the water distribution line 325 can represent a sprinkler system in case of a fire, in which water is supplied from the plumbing cartridge 131. In other scenarios, the water distribution line 325 can represent a water line to supply water to the fixtures in the different cartridges, such as toilets, faucets, showers, tubs, and other water fixtures. The air duct network 328 can represent multiple air ducts that distribute air conditioned or heated air from the systems cartridge 134 to multiple access points throughout the modular building structure 100.

As shown in FIG. 3C, the air duct network 328 can include various duct access points 331*a-d* (collectively "the duct access points 331"). Each duct access point 331 can provide heated or cooled air from the systems cartridge 134.

Figure 4A:
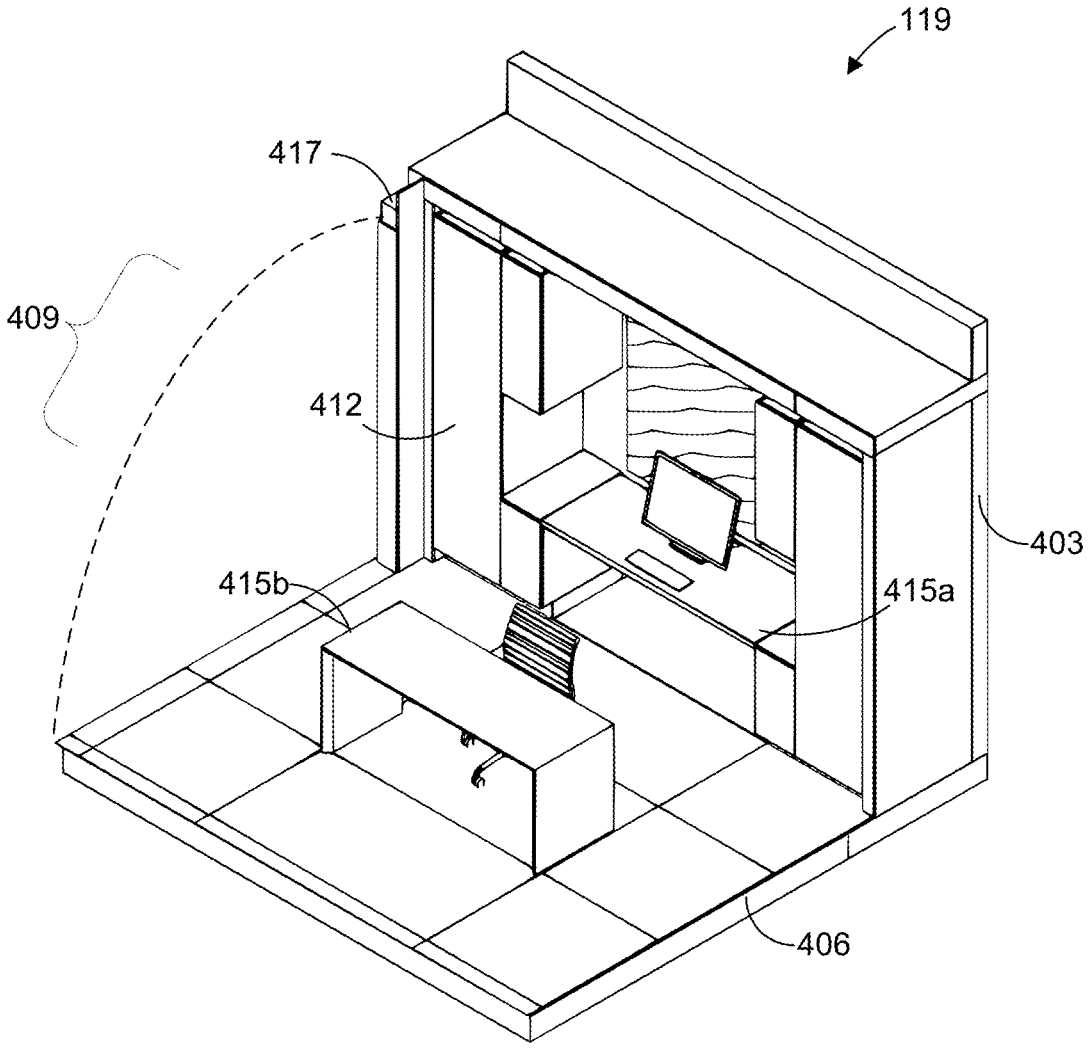
FIGS. 4A-4N illustrate the enlarged views of the various cartridges shown in FIG. 1B, according to one embodiment described herein.
Figure 4B:
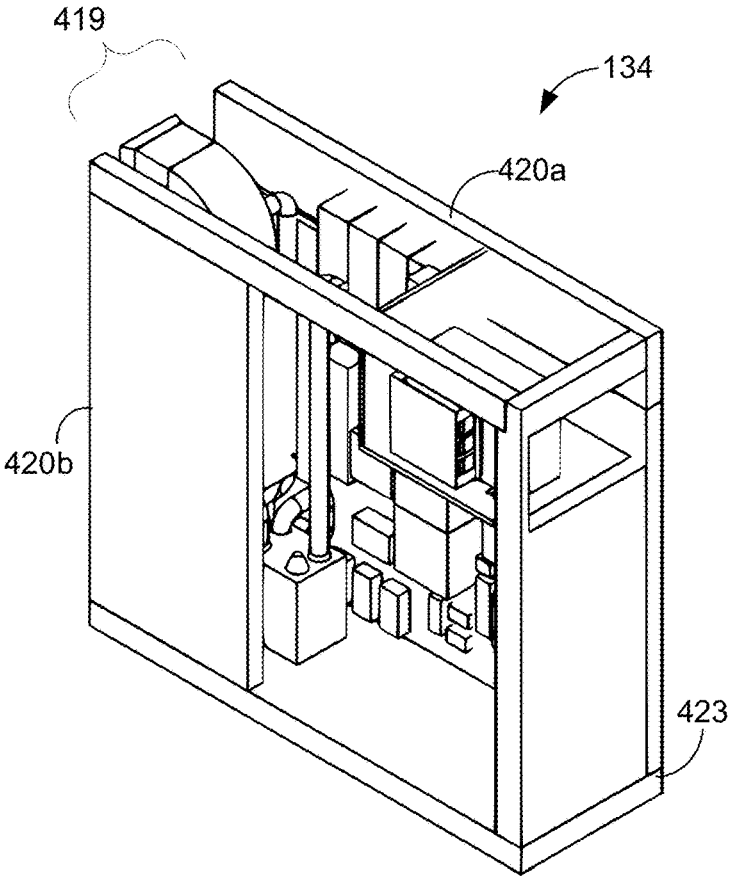
Figure 4C:
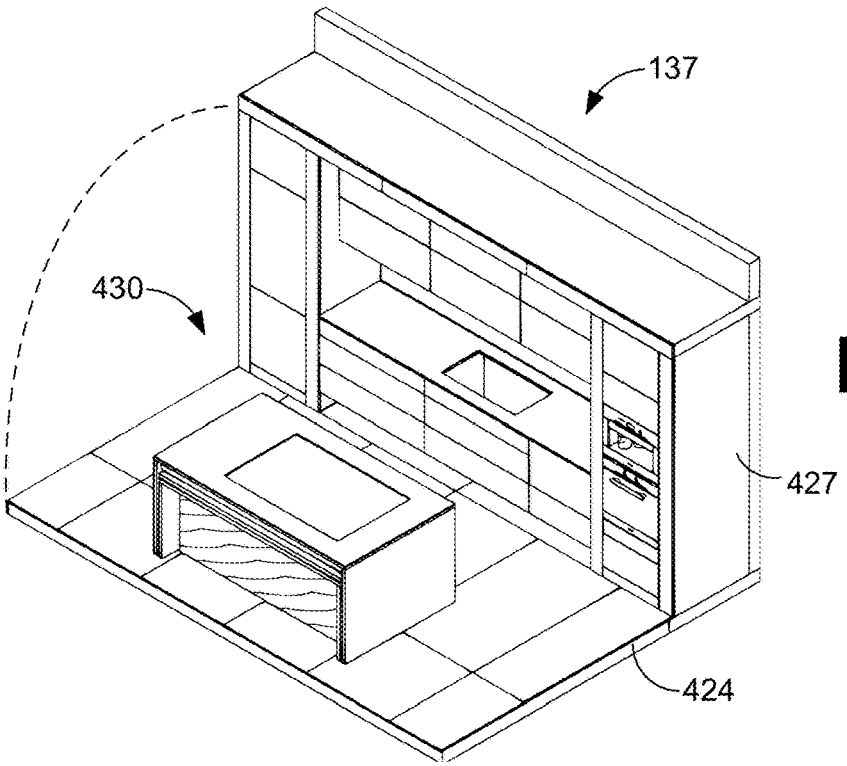
Figure 4D:
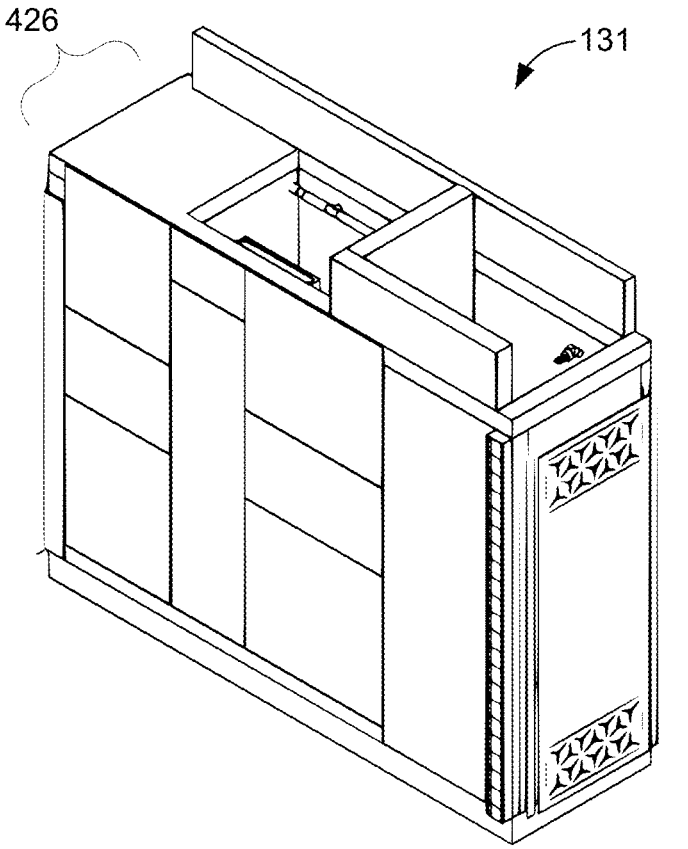
Figure 4E:
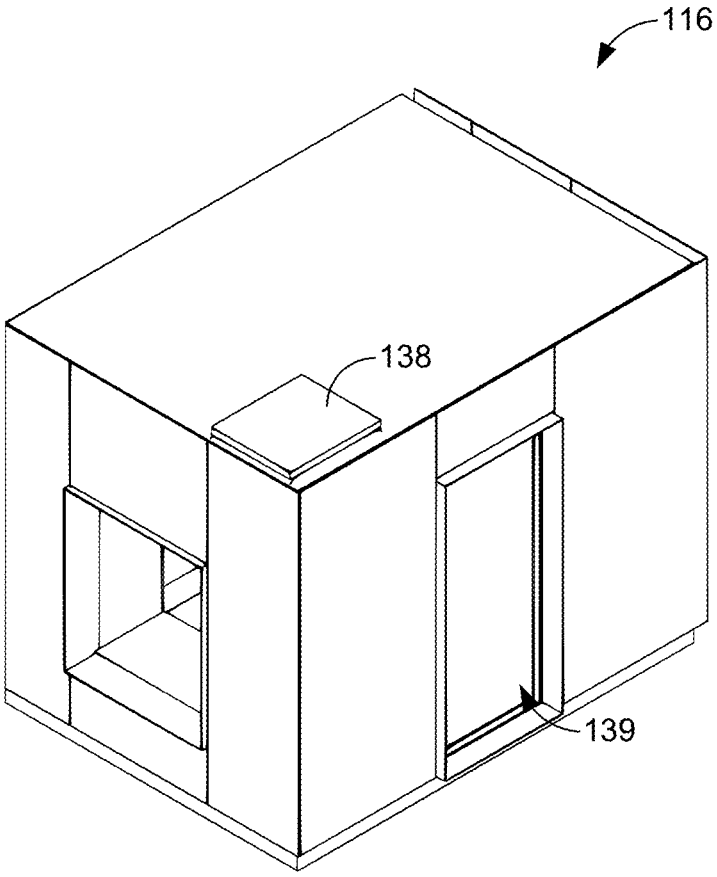
Figure 4F:
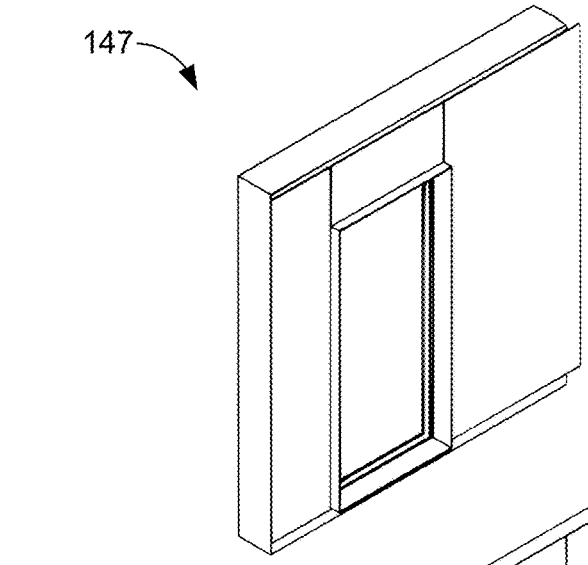
Figure 4G:
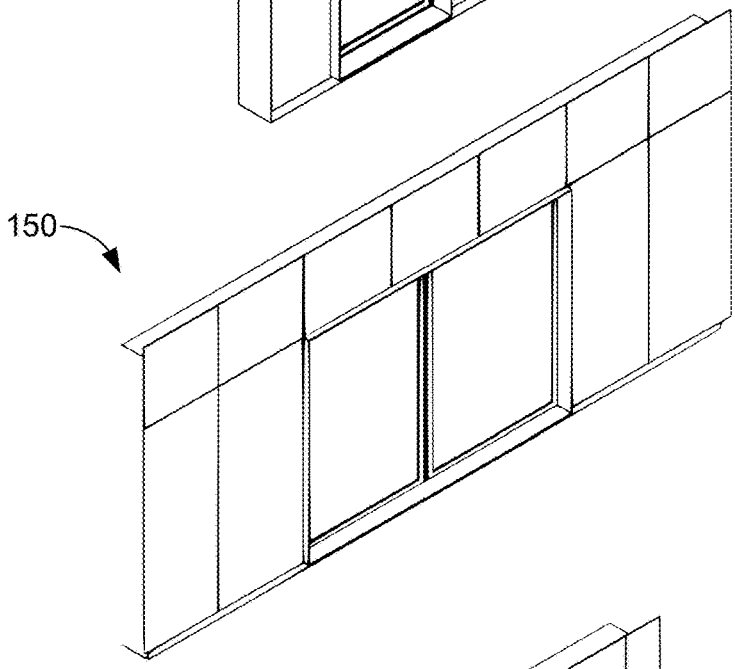
Figure 4H:
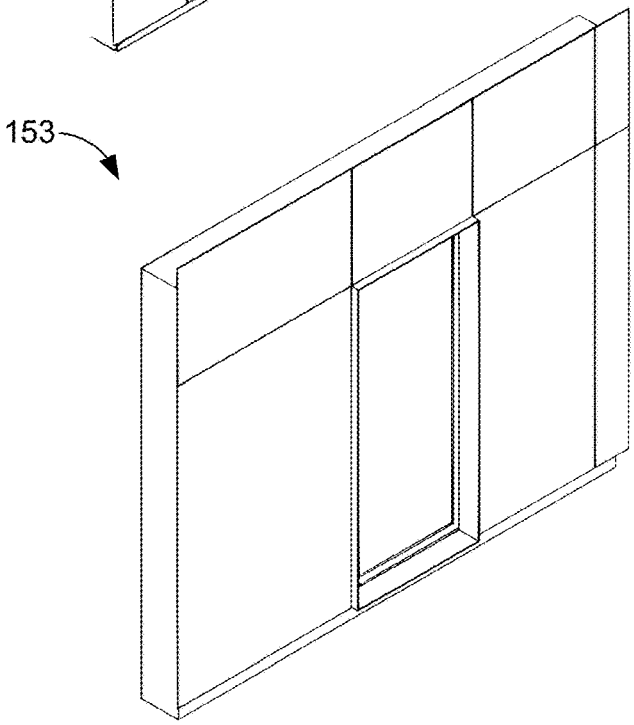
Figure 4I:
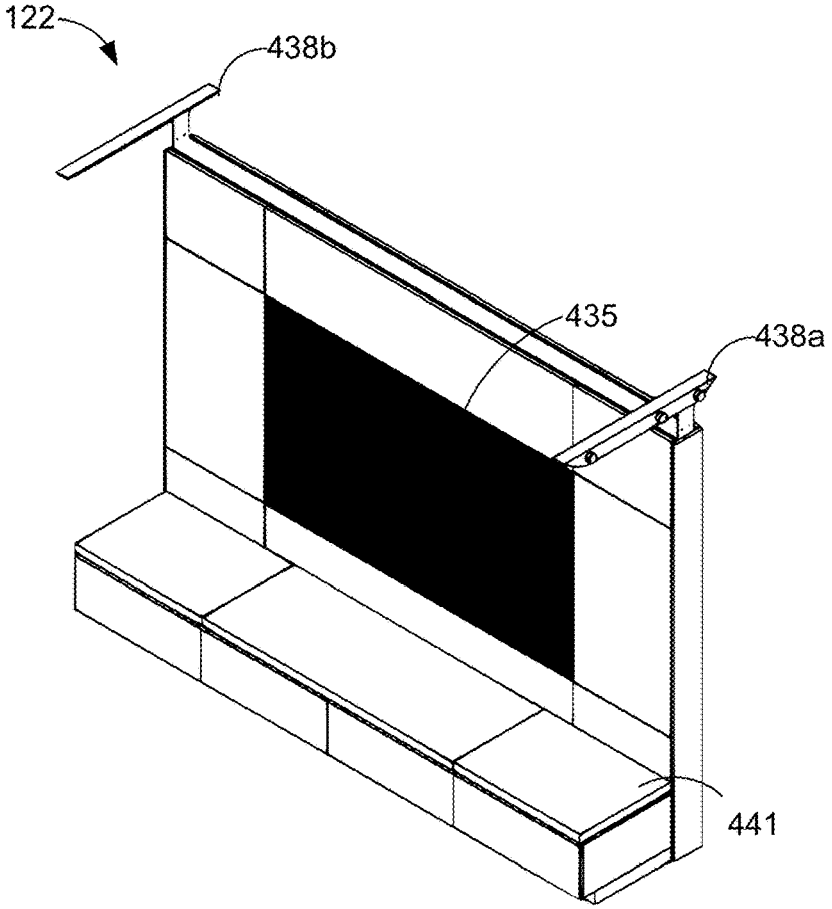
Figure 4J:
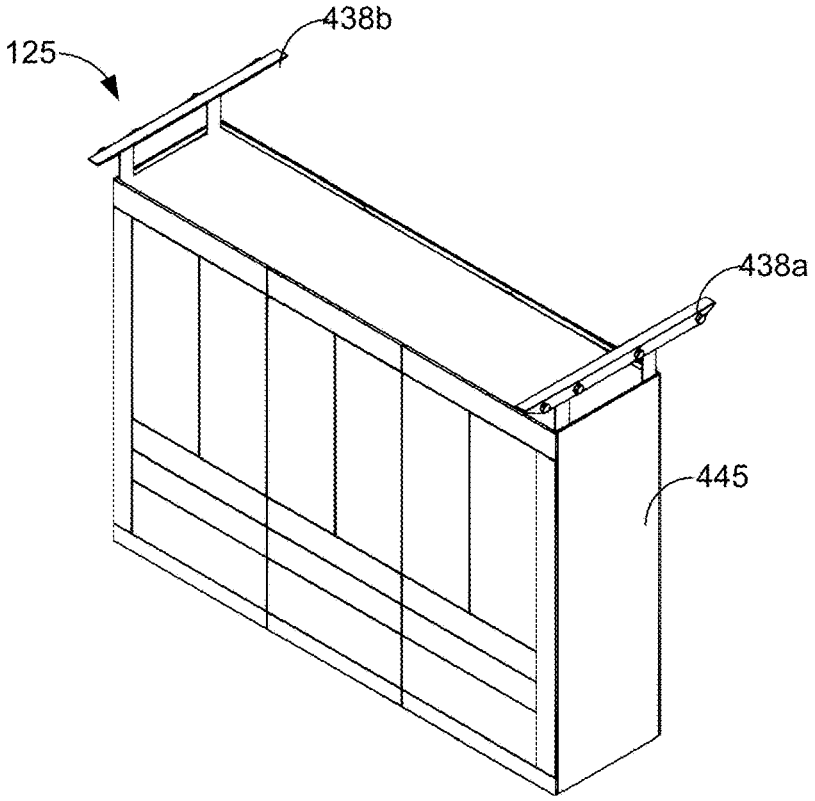
Figure 4K:
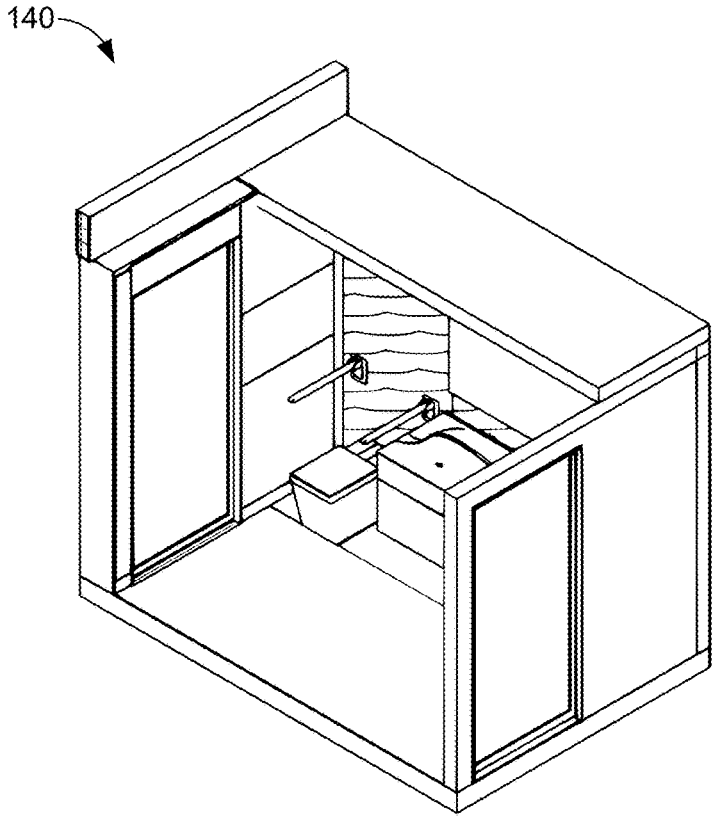
Figure 4L:
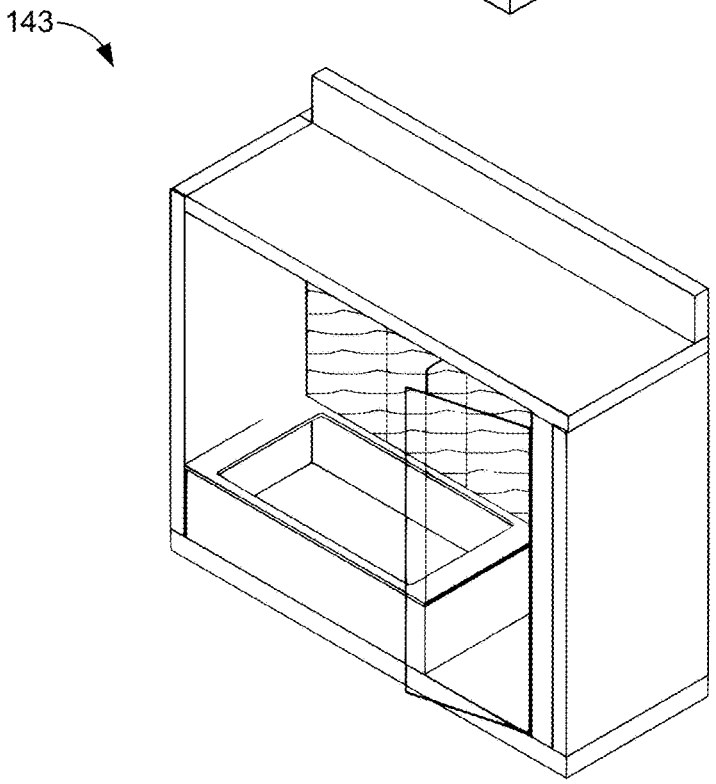
Figure 4M:
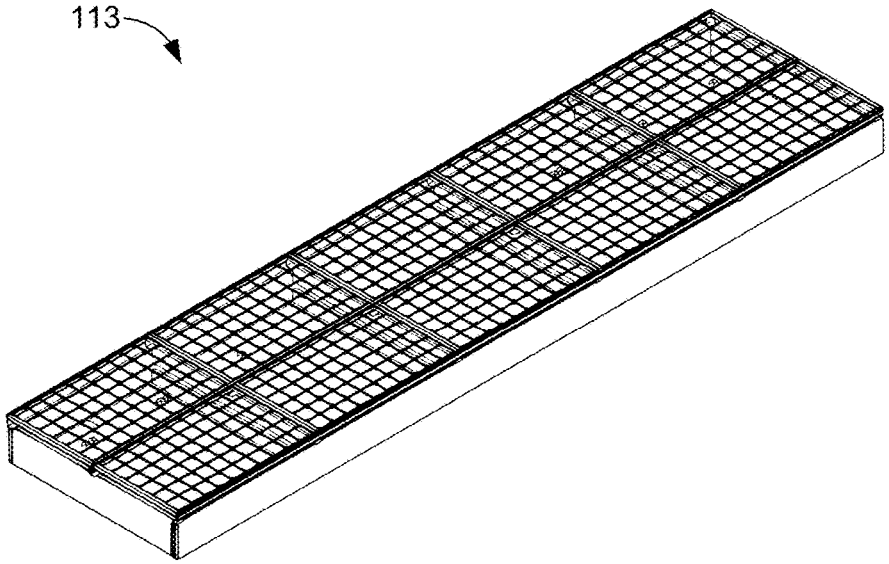
Figure 4N:
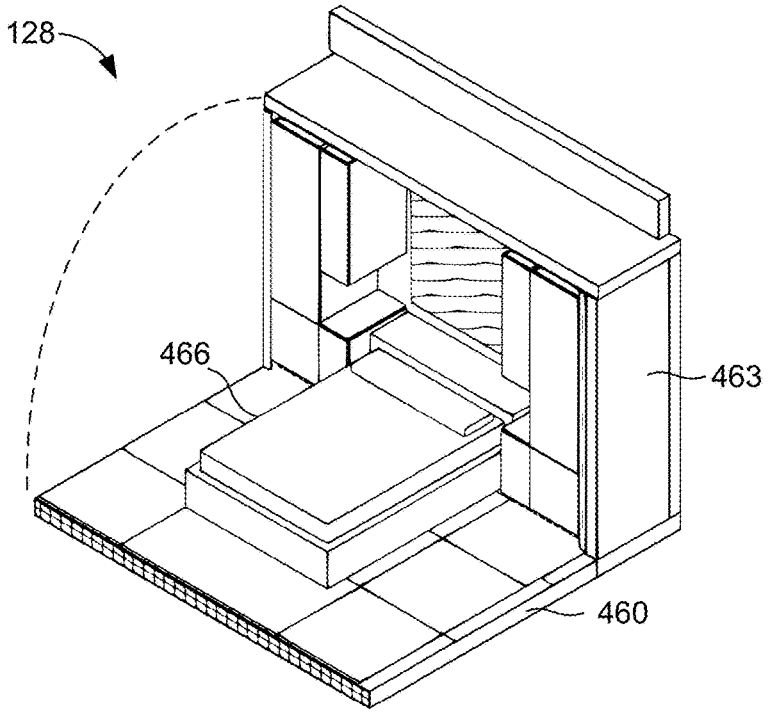

With references to FIGS. 4A through 4N, shown are enlarged views of the cartridges 103 from FIG. 1B. Additionally, in some embodiments, the cartridges 103 can be networked connected to the computing device 157. As such, the structure application 166 can be used to control the movement of structural components of the cartridges, such as cabinets, beds, desks, walls, media equipment, and other structural components. As such, the structure application 166 can control the operation of actuators 160, motors, and other structural components used to move or manipulate these structural components. The various interior surfaces (e.g., countertops, desks, cabinets, etc.) may have an antimicrobial surface or layer to limit the growth of bacteria. In some scenarios, these surfaces may have antimicrobial treatments to prevent or inhibit the growth of bacteria, fungi, and other microorganisms.

In addition, the health application 168 can be used to monitor the health of one or more individuals occupying the modular building structure 100. For example, in some implementations, all of or a subset of the cartridges 103 can be referred to as Connected Health Cartridges (CHC)—Smart, digitally connected prefabricated bathrooms, kitchens, offices, bedrooms, living rooms, etc. that plug-in or connect to a central home operating system (e.g., the health application 168).

In this example, the suite of cartridges 103 can incorporate technology to monitor a resident's health and measure vital signs. The instrumentation installed in "plug-and-play" prefabricated modules or "cartridges" can relay health information to doctors and caregivers, allowing them to monitor the well-being of a resident or residents. In these cartridges 103, multiple devices can be pre-installed in the prefabricated walls 148 or rooms so on-site installation is made simple. The plug-and-play components allow for complex factory or off-site installation of multiple types of technology including monitoring sensors and cameras, telehealth or telemedicine consoles and devices, multi-modal interfaces that allow users of different disabilities to operate and adjust all components of the home from lighting to appliances, to countertop heights. Multimodal interfaces include voice control, touch control, gesture control, touch displays or PDAs and manual switches (among others).

FIG. 4A is an enlarged perspective view of the office cartridge 119. FIG. 4A is one non-limiting example of the office cartridge 119. In the illustrated example, the office cartridge 119 comprises an office wall 403 and an office floor 406. The office cartridge 119 includes office furniture 409 that can be attached to the office floor 406 and/or the office wall 403. For example, FIG. 4A illustrates an office cabinet 412 and a first office desk 415*a* attached to the office wall 403. A second office desk 415*b* is attached to the office floor 406. As noted above, the cartridges 103, such as the office cartridge 119, can be prefabricated. The office cabinet 412, first office desk 415*a*, and the second office desk 415*b* can have an actuation assembly attached (FIG. 6A-6C) for adjusting the position of these components.

Part of the prefabrication process can include assembling or attaching office furniture 409 to the office cartridge 119. In some scenarios, the office furniture 409 can be manipulated in preparation for transportation of the office cartridge 119. For example, the office cabinets 412 may adjust to a different position or a portion of the office floor 406 may pivot upward, as indicated by the dashed line in FIG. 4A. These adjustments can be made to reduce the footprint size of the office cartridge 119. In other cases, the adjustments may be made in order to configure the office cartridge in a manner that will reduce a likelihood of damage occurring during transportation. Additionally, the office cartridge 119 can include a subpanel 417 that connects to the spine cartridge 110. The subpanel 417 can represent a location that consolidates one or more home run connections, such as an electrical connection, a wired network connection, and other suitable connections.

The office cartridge 119 is one example of a CHC. This office cartridge 119 may contain a computer, monitor, or telehealth console to allow a resident to communicate with their doctor or caregiver from their office desks 415*a*, 415*b*. Here the resident also can access all equipment needed to relay vital sign info to the attendant.

Next, FIG. 4B illustrates one example of a systems cartridge 134. The system cartridge 134 can provide various services for the modular building structure 100. For example, the systems cartridge 134 can provide services such as electrical power, heating, ventilation, and air conditioning and other suitable services. In some respects, the systems cartridge 134 can represent the engine of the modular building structure 100 because the systems cartridge 134 can include systems associated with generating and/or distributing these services. For example, the systems cartridge 134 can include some or all of the systems 419 used for a residence (or other) unit. Some systems may include HVAC systems, electrical panels pre-wired and set up for "home run" electrical hookup for house or cartridge circuits. Each cartridge 103 can include a sub-electrical panel preinstalled in the factory that consolidates all electrical within the pod to that one panel. The "home run" wires can connect to the main breaker panel in the systems cartridge 134. Other systems in the systems cartridge 134 may include HVAC controls, air exchange units, inverters and charge controllers for the solar power cartridge 113, lighting controls. The systems cartridge 134 can include walls 420*a*, 420*b*, a ceiling, a floor 423, and other structure components. These structural components can be fire rated as required by a governing code. Some of the systems 419 may be attached to the wall 420.

Next, FIG. 4C illustrates is an example of a kitchen cartridge 137. The kitchen cartridge 137 can include a kitchen floor 424, a kitchen cabinet 427, kitchen furniture 430. The kitchen cabinet 427 can include appliances, a sink, a faucet, and other suitable kitchen components. The kitchen furniture 430 can represent a kitchen island, a kitchen table, and other suitable furniture. The kitchen furniture 430 can be attached to the kitchen floor 424. The kitchen floor 424 can pivot upwards towards the top of the kitchen cartridge 137, as indicated by the dashed line in FIG. 4C.

Figure 6A:
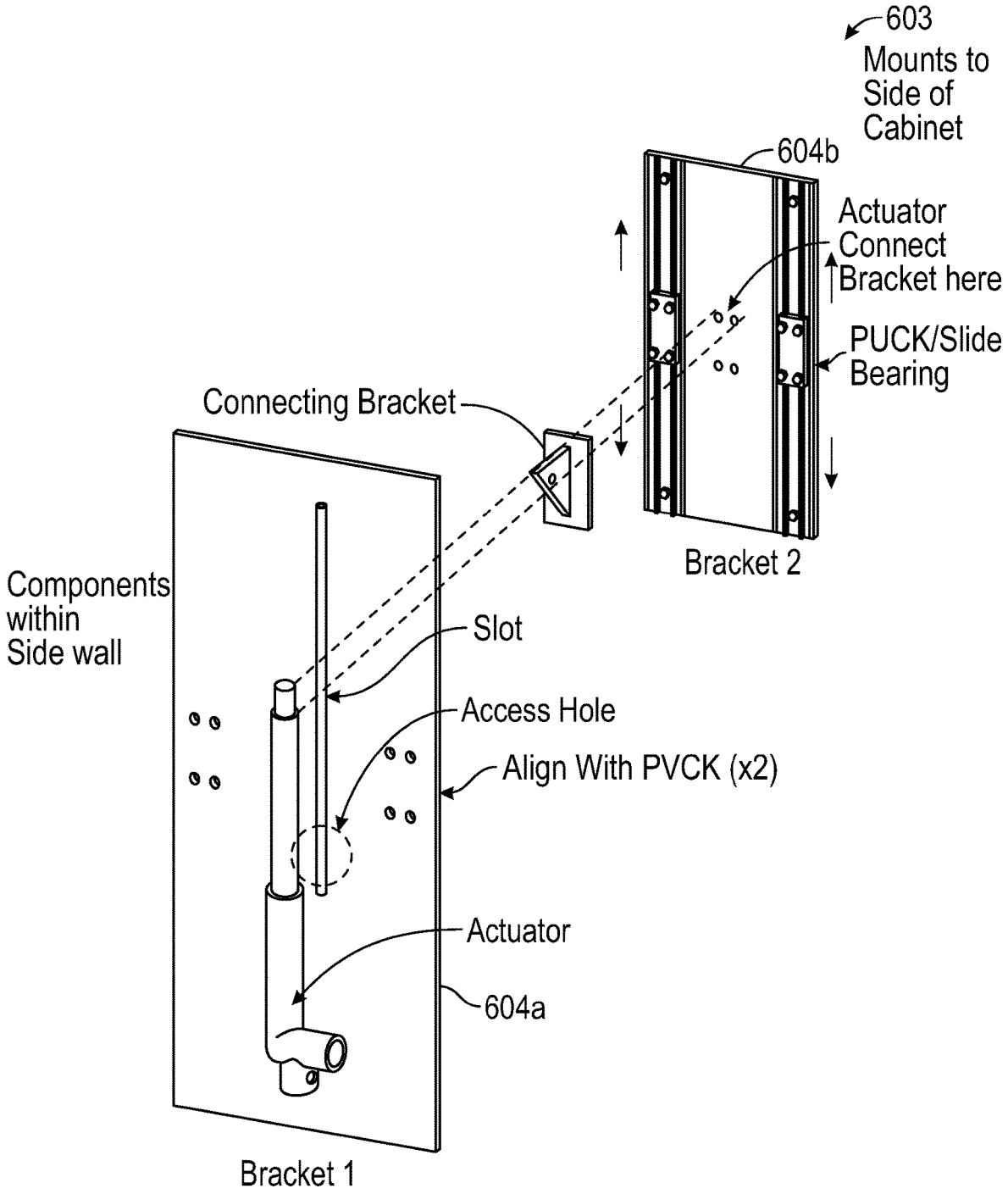
FIGS. 6A-6C illustrate drawings of cabinet actuation assemblies, according to one embodiment described herein.
Figure 6B:
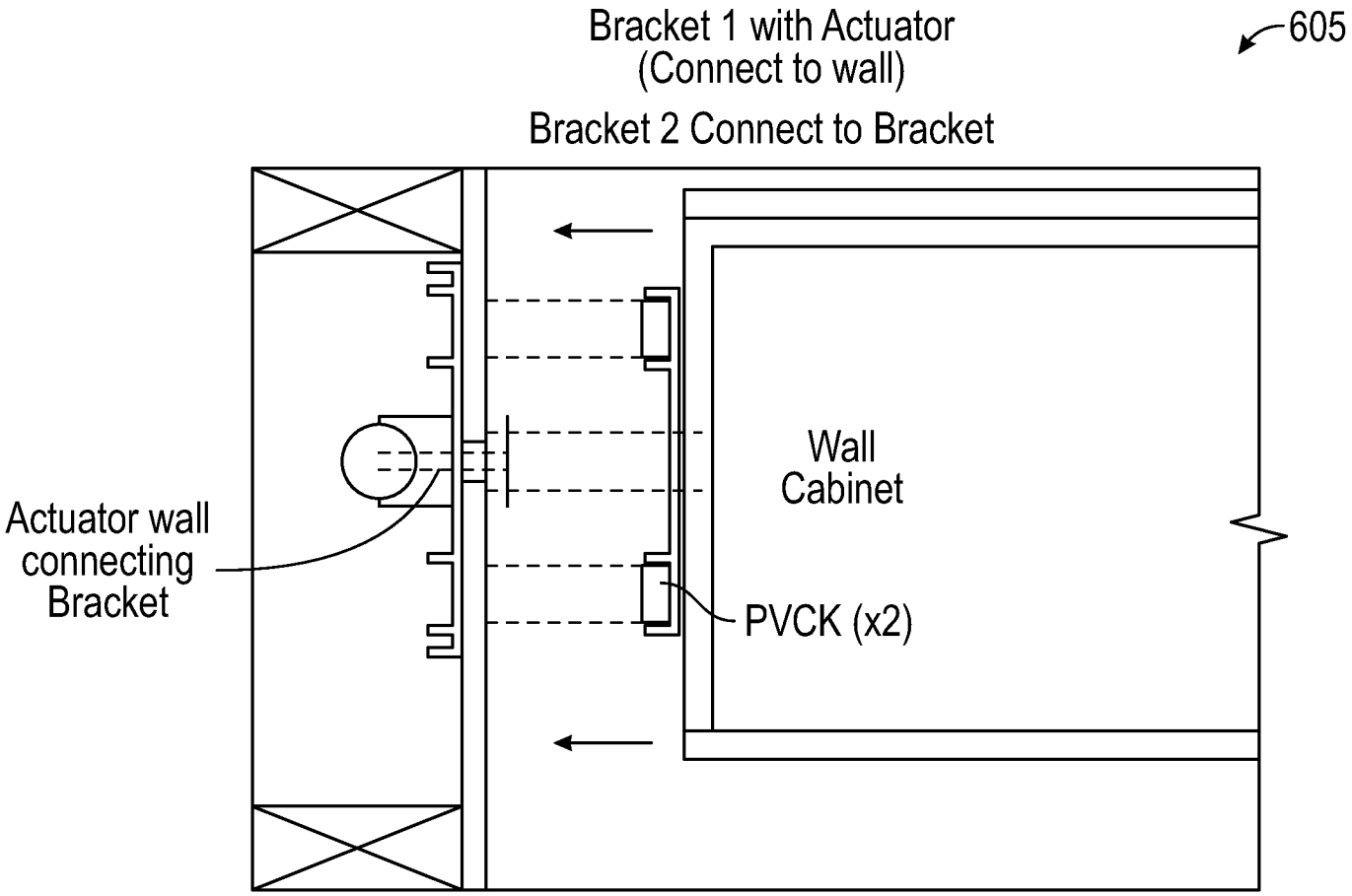
Figure 6C:
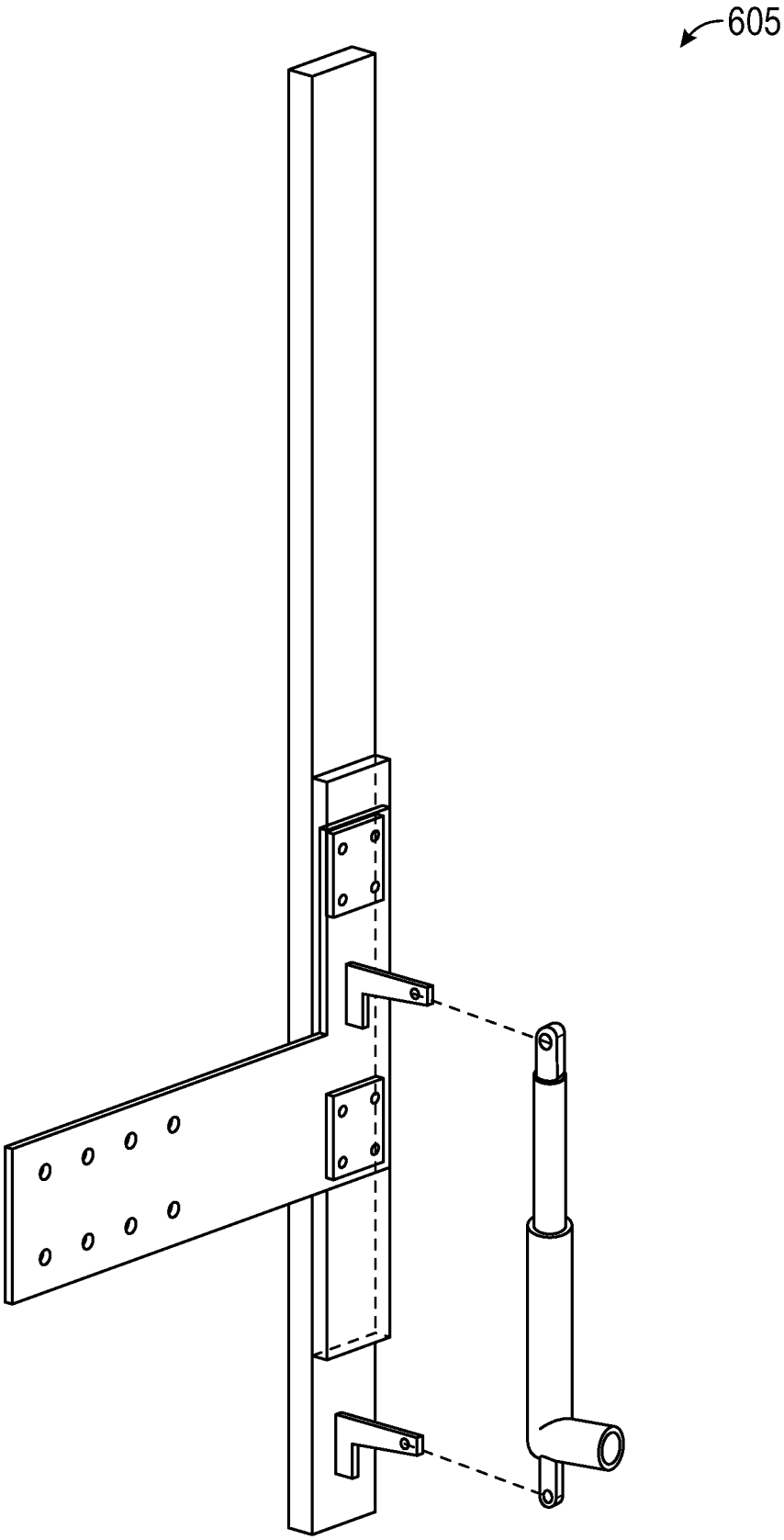

In some embodiments, the kitchen cartridge 137, and potentially other cartridges, can include actuation functionality for the kitchen cabinet 427, which may include side wall mounted actuators (FIGS. 6A-6B) and/or a rear wall mounted actuator and sides (FIG. 6C). It should be noted that other systems of cabinet actuation may be implemented.

Unlike existing cabinet designs, these two cabinet examples allow for the entire bank of cabinets to raise and lower so cabinet storage space is not lost, and continuous countertop surfaces can be adjusted without splitting levels. Both examples provide lifting ability of lower base cabinets and/or upper wall cabinets to provide height adjustment and therefore better accessibility or reachability.

Moving on to FIG. 4D, shown is a plumbing cartridge 131. The plumbing cartridge 131 can provide various water related services to the various portions of the modular building structure 100. The plumbing cartridge 131 can include various water systems 426, such as water tanks, filters, solar thermal system, heat exchangers, smart controls among other systems, such as a laundry and storage appliances. In some examples, the plumbing cartridge 131 can be installed adjacent to the kitchen cartridge 137 and/or the bathroom cartridges 140, 143. The plumbing cartridge 131 can include walls, a plumbing wall, pillars, and other suitable components for supporting the plumbing systems.

With reference to FIG. 4E, shown is an example of an entry cartridge 116. The entry cartridge 116 can include a first doorway from the outside and a second doorway that leads to the interior of the modular building structure 100. In some embodiments, the entry cartridge 116 may include a mailbox for receiving mail. The mailbox may be installed inside the of the entry cartridge or may be installed along a street side curb. In some examples, the mailbox may be refrigerated for receiving grocery deliveries by hand or drone.

A mailbox delivery unit can open from the front wall for standard deliveries or from the top for drone deliveries. As such, the entry cartridge 116 may include a topside automated door 138 or a side automated door 139. The automated doors 138/139 can be activated by radio frequency identification (RFID) or similar electronic identification. In some cases, the automated doors 138/139 may be activated based on a tracking number or delivery service code. The automated doors 138/139 can provide access to the mailbox delivery unit. The mailbox delivery unit can be insulated and contain a cooling unit activated by grocery delivery. The mailbox delivery unit can keep the perishable packages cool until the homeowner returns home. If delivered by drone, the entry cartridge 116 can deploy a platform that lowers the package into the mailbox delivery unit.

Additionally, FIGS. 4F-4H illustrates different combinations of example doors. FIG. 4F is an example of an exit door cartridge 147. FIG. 4G is an example of a living room door cartridge 150. As shown in FIG. 4G, the living room door cartridge 150 can be a sliding door, a patio door, a set of French doors, and other suitable doors. FIG. 4H is an example of a bedroom door cartridge 153.

The exit door cartridge 147, the living room door cartridge 150, and the bedroom door cartridge 153 can be considered as door portals. These door cartridges can be wall assemblies that are standalone plug-and-play assemblies. The door cartridges can include a prefabricated door assembly that incorporates all the systems associated with a building entryway including access, sun protection, privacy, and weather control. The "plug and play" assembly can be attached to an existing home entryway or incorporated into new construction as a cartridge component. Some door portals that can be included are electronically controlled motorized doors and windows, motorized shades, bug screens, security systems, security access, etc. These portal walls can also include structure and be used for structural load bearing components of homes. For example, the living room door cartridges 150 can include motorized sliding doors that laterally pull away from each other for creating an opening and pull together each other to close the opening. In other examples, the living room door cartridges 150 may include motorized doors that pivot in order to open and close.

Next, FIG. 4I is an example of a media cartridge 122. In this example, the media cartridge 122 includes a display 435, slides 438*a*/438*b* (collectively the "slides 438"), seating furniture 441, and other suitable components. In some implementations, the media cartridge 122 can be a media wall, in which the seating furniture 441 is omitted. The slides 438 can represent a guide or a rail that facilitates the media cartridge 122 moving from a first location to a second location. In some examples, the media cartridge 122 can include a central frame that allows the display 435 or a partition within the wall to spin 360 degrees (FIGS. 8A-8D).

Moving on to FIG. 4J, shown is an example of closet cartridge 125. The closet cartridge 125 comprises a closet 445, slides 438, and other suitable components. The closet cartridge 125 can be viewed as movable closet or as a movable wall. The closet cartridge 125 and/or a moveable wall can subdivide multiple spaces throughout the day and night to accommodate specific real time needs. The embodiments include the hardware that suspends a wall or closet/cabinet from an overhead rail or slide (e.g., slide 438). The closet assembly system and/or a wall assembly can include two parts, a pair of brackets and a pair of rails. The rails can be mounted from a ceiling or from two adjacent walls. Each bracket has a wide base with two or more v-groove track bearings or rollers that mate with the v track. The wide base allows lower walls to carry attached furnishings without racking or bowing. Diagonal cables that cross brace between the two wide brackets above keep the wall moving parallel with each other. This cable system could also be replaced by a shear panel for the same stabilizing effect.

Next, FIGS. 4K and 4L illustrate an example of a first bathroom cartridge 140 and an example of a second bathroom cartridge 143. As shown in FIGS. 4K and 4L, the first bathroom cartridge 140 has a larger footprint than the second bathroom cartridge 143. The first bathroom cartridge 140 includes a toilet, a sink, a faucet, and other suitable bathroom fixtures. The second bathroom cartridge 143 includes a tub, a shower, and other suitable bathroom fixtures. The allocation of bathroom fixtures can vary.

Next, FIG. 4M is an example of a solar power cartridge 113. In the illustrated example, the solar power cartridge 113 is a photovoltaic panel. However, the solar power cartridge 113 can include other solar harvesting technologies. A prefabricated modular frame can incorporate a photovoltaic and/or solar thermal system. The frame allows for full installation including the interconnecting and grounding of multiple solar panels. One "home run" connection allows for the simple "plug and play" of the system. The frames are sized to fit on standard sized flatbed trucks or shipping containers and are structured for long spans to resist snow loads and only require a few roof mounting locations to limit roof penetrations.

Moving on to FIG. 4N, shown is an example of a bedroom cartridge 128. The bedroom cartridge 128 can include a bedroom floor 460, bedroom cabinets 463, a bed 466. The bedroom floor 460 can pivot upwards to the top of the bedroom cartridge 128, as indicated by dashed lined. The bed 466 can be attached to the bedroom floor 460. The bedroom cabinet 463 can have an actuation assembly attached (FIG. 6A-6C) for adjusting the position of the bedroom cabinet 463. The bed 466 can have an actuation assembly attached (FIG. 5) for pivoting the bed up for storage and pivoting it down for use.

The bedroom cartridge 128 is one non-limiting example of a CHC that can be equipped with its own electrical sub-panel and communications hub (such as ethernet) for plug-and-play connectivity with other cartridges (rooms). In this example, the bedroom cartridge 128 can include several monitoring devices that monitor the resident's sleeping patterns, habits and abnormalities such as their sleeping schedule, REM sleep, or signals of sleep apnea for example. Room monitors can detect movement or more importantly lack of movement. For instance, the bedroom cartridge 128 may include a sleeping device, such as a continuous positive airway pressure (CPAP) device or a camera for monitoring an individual's vital signs.

The bedroom cartridge 128 can also include sensors 163 for detecting movement of the individual around the bedroom cartridge 128, the bathroom cartridges 140/143, and other areas of the modular building structure 100. The sensors 163 can detect slips in the bedroom and falls from the bed. When an alarm is detected, such as for a fall or an apnea event, caregivers can be notified through a range of methods such as texts, and phone calls. Lighting systems in the bedroom are easily controlled by multi modal methods. Automatic lighting is also used for night-lighting, for way-finding, light therapy, and signaling for the hearing impaired, etc.

Figure 5:
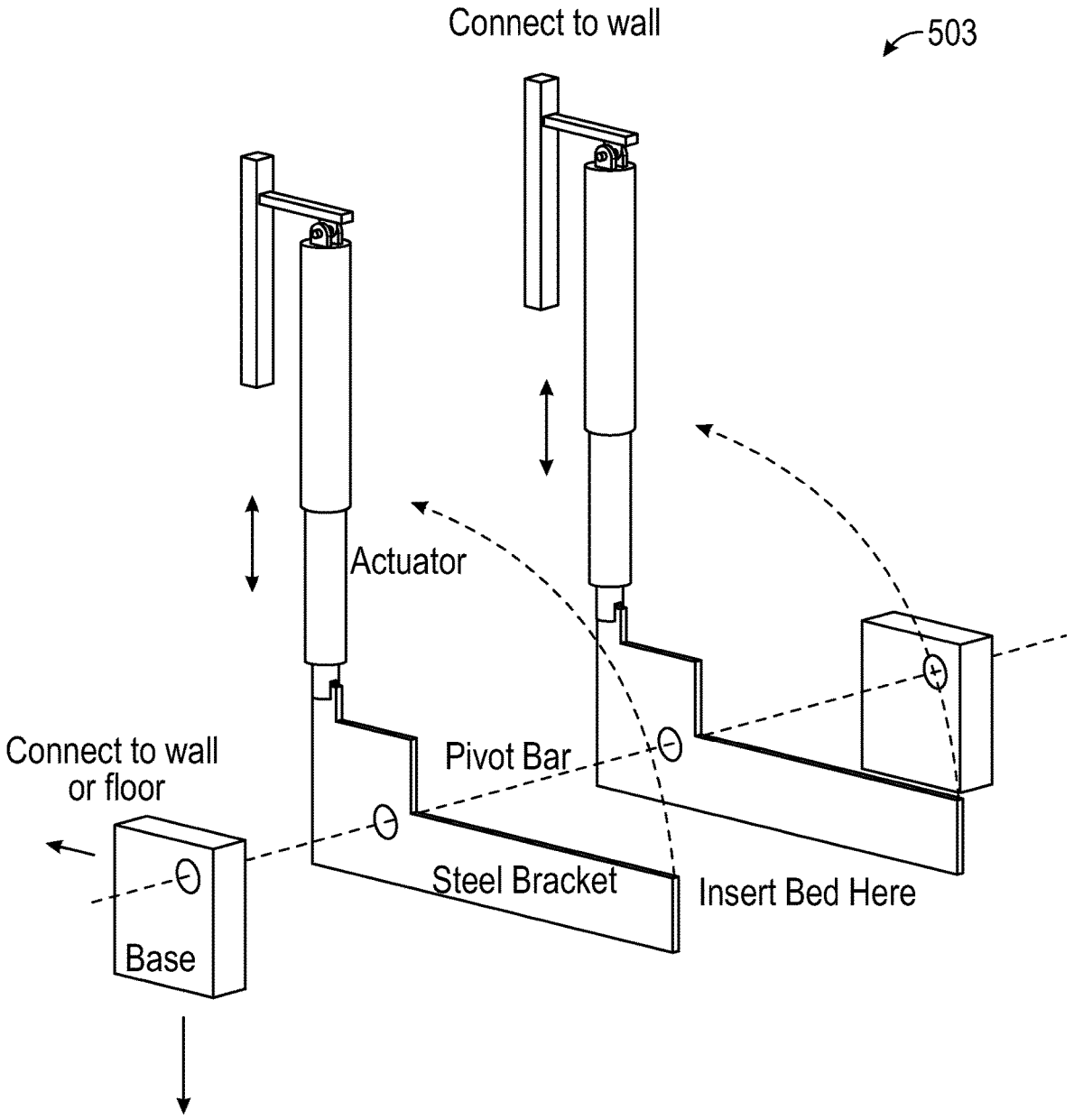
FIG. 5 illustrates a drawing of an adjustable bed assembly, according to one embodiment described herein.

Next, FIG. 5 illustrates an adjustable assembly 503 for the bed 466 (FIG. 4N) in the bedroom cartridge 128. The adjustable assembly 503 may be manipulated to different positions, such as a sleeping position or a storage position. The adjustable assembly 503 of the bed 466 may include an electrically actuated bracket device that is designed to embrace any standard bed frame. As such, the adjustable assembly 503 can allow the bed 466 to be deployed into a vertical storage position. Many standard motor actuated "murphy" beds can only lift standard or lightweight mattresses. The adjustable assembly 503 can lift a heavy frame of the bed 466 with the mattress that contains many of the smart components that come with a fully adjustable smart bed like internal actuators for adjustability, sensors, motors, air pumps, and controls. The high power actuators can be sized to accommodate any size bed, (e.g., queen, king, etc.). The bracket assembly includes two parallel brackets that connect to the commercial bed frame (that in turn carries the mattress). The two parallel brackets pivot on a central post that is carried by two structural side posts (mounted to the floor or wall). Two wall-mounted actuators push down on a 1' to 2' offset of the frame allowing the brackets to lift the adjustable assembly 503. The 1' to 2' offset space can be used as a headboard/pillow box for the adjustable assembly 503.

Moving on to FIG. 6A, shown is an example of side wall cabinet actuation assembly 603. In this example, the side wall cabinet actuation assembly 603 can include flanking sidewalls 604*a* and 604*b* of a cartridge 103 or a space with actuators 160 and slides. The 4"-6" vertical wall unit fits within standard modular and custom cabinet systems. They can be specified as modular cabinet components when the designer is selecting cabinet components such as base cabinets, wall cabinets, and tall cabinets. The system is composed of a pair of vertical "column" wall assemblies (one left and one right). Each is composed of a two-part wall bracket designed for the attachment of the base or wall cabinet to the vertical column. Each column contains (1) an electronic actuator and heavy-duty glide/guides mounted on a bracket and (2) a cabinet bracket designed to mate with the column bracket system. By preinstalling both brackets on the column and the cabinet, it guarantees the bolt thread locations will match up.

FIGS. 6B and 6C illustrate an example of a rear wall cabinet actuation assembly 605. In this example, the rear wall cabinet actuation assembly 605 can include rear mounted actuators and slides/guides. A pair of columns, each equipped with an actuator, heavy duty slide, and a structural cantilevering bracket, can be attached to vertical framing members (studs) of walls to collectively embrace the vertical sides of a vanity or base cabinet to provide height adjustability.

This actuated wall frame raises and lowers two cantilevered, parallel, steel brackets in a linear vertical path that carries the cabinet. The actuator can be controlled by multimodal methods (physical switch, touch pad, phone, voice control, touch control, gesture control or any other type of electronic interface).

Figure 7A:
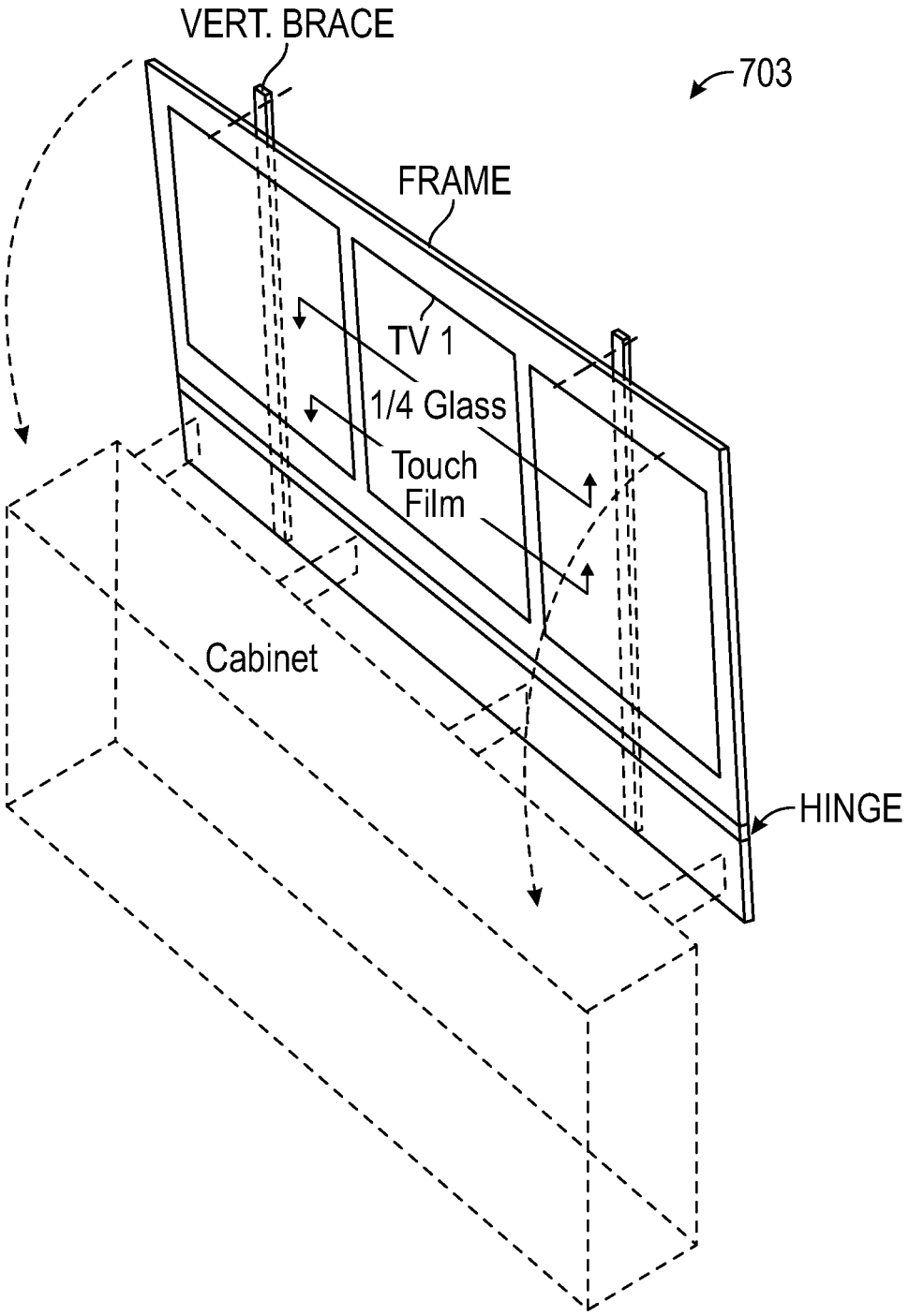
FIGS. 7A and 7B illustrate drawings of a modular media frame assembly, according to one embodiment described herein.
Figure 7B:
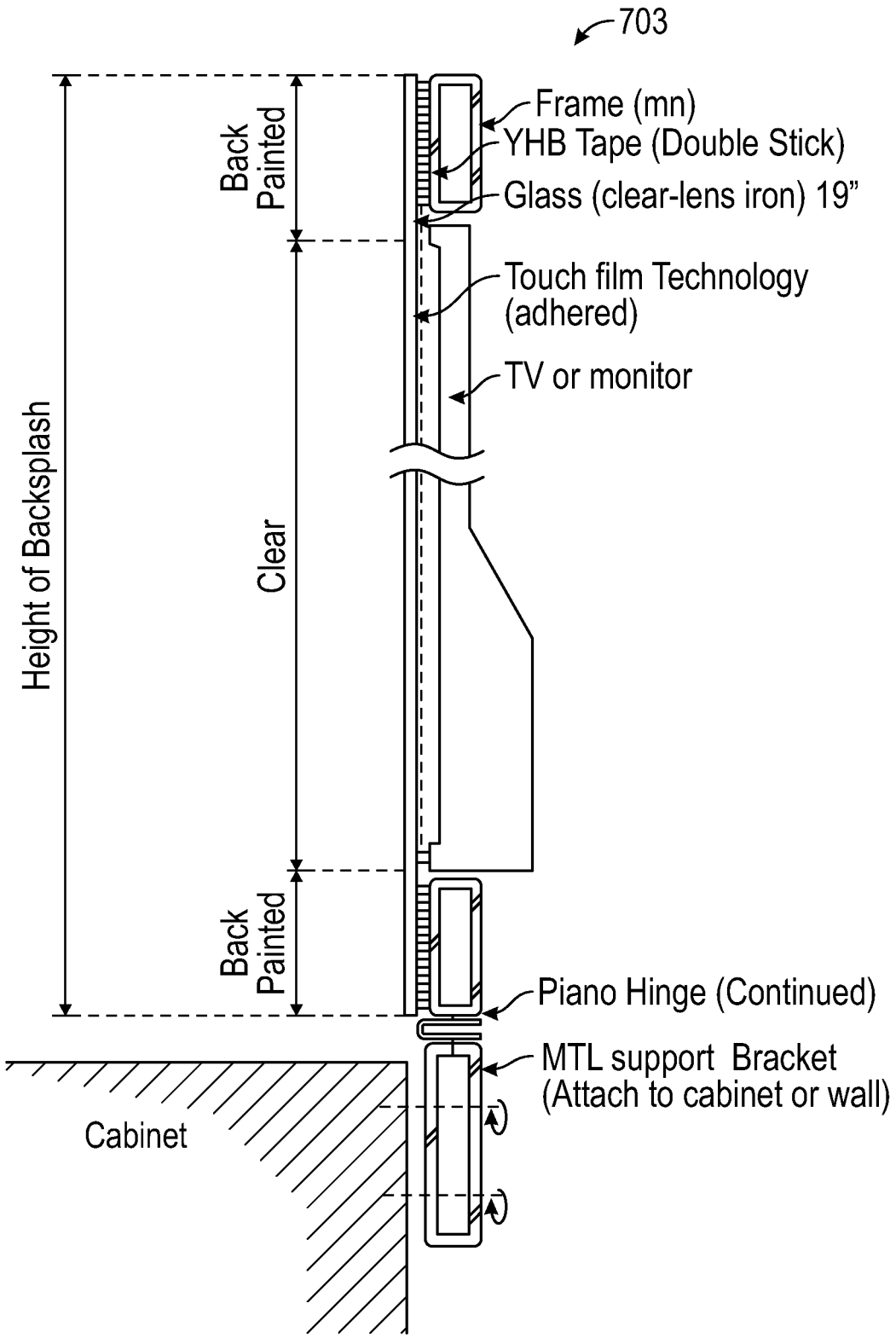

Moving on to FIGS. 7A and 7B, shown are drawings of a modular media frame assembly 703. In some embodiments, a cartridge 103, such as a kitchen cartridge for example, may include the modular media frame assembly 703. The modular media frame assembly 703 can designed to receive off the shelf LCD TV monitors and in conjunction with a touch film technology and glass cover, to become an interactive touch screen display for a kitchen or cabinet wall. The frame can come in standard sizes to match typical backsplash heights and may vary in width to match the typical base cabinet module increments 9", 12", 15", 18", 21", 24", 36" and other suitable sizes. The frame consists of two parts, a lower base/bracket that anchors to the back side of a lower cabinet or directly to a wall, and a top (TV wall) that hinges down to easily service the TVs and electronics on the back of the frame. Having the ability to lower the TV assembly also allows users access to systems behind the device such as electrical, electronic and plumbing systems of the house. When in the upright position, the glass serves as a waterproof, cleanable layer that protects the components behind from kitchen spills and splashes.

With reference to FIGS. 8A-8D, shown is an example of a media frame assembly 803 for a media cartridge 122 (FIGS. 1B and 4I). In some examples, the central media frame assembly 803 is located approximately in the center of a wall of the media cartridge 122. In other examples, the central media frame assembly 803 may be located off-center.

Figure 8A:
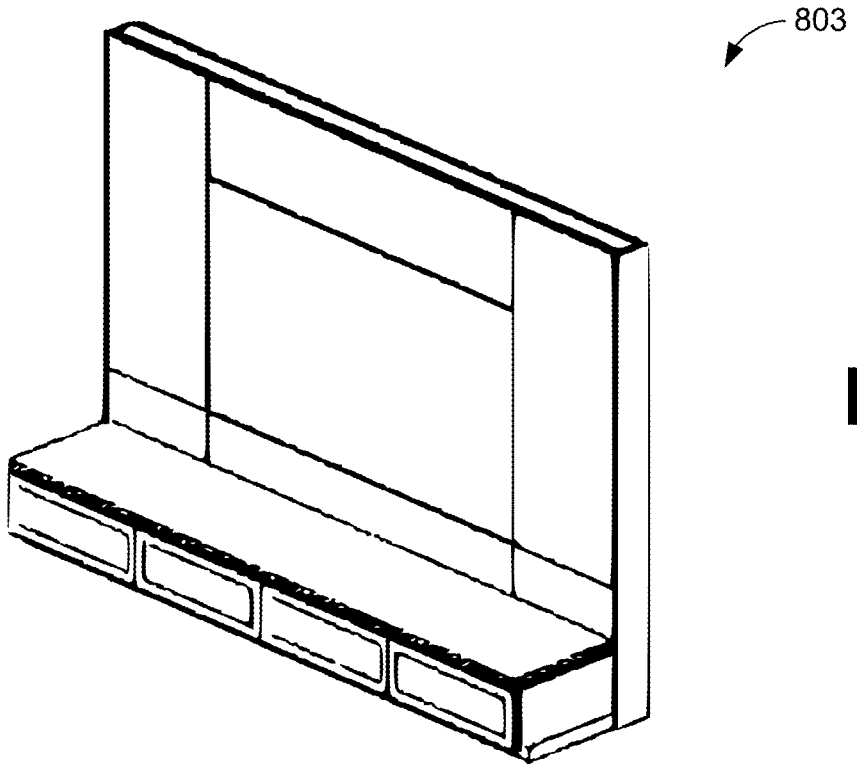
FIGS. 8A-8D illustrate drawings of a media frame assembly for the media cartridge shown in FIG. 1B and FIG. 4I, according to one embodiment described herein.
Figure 8B:
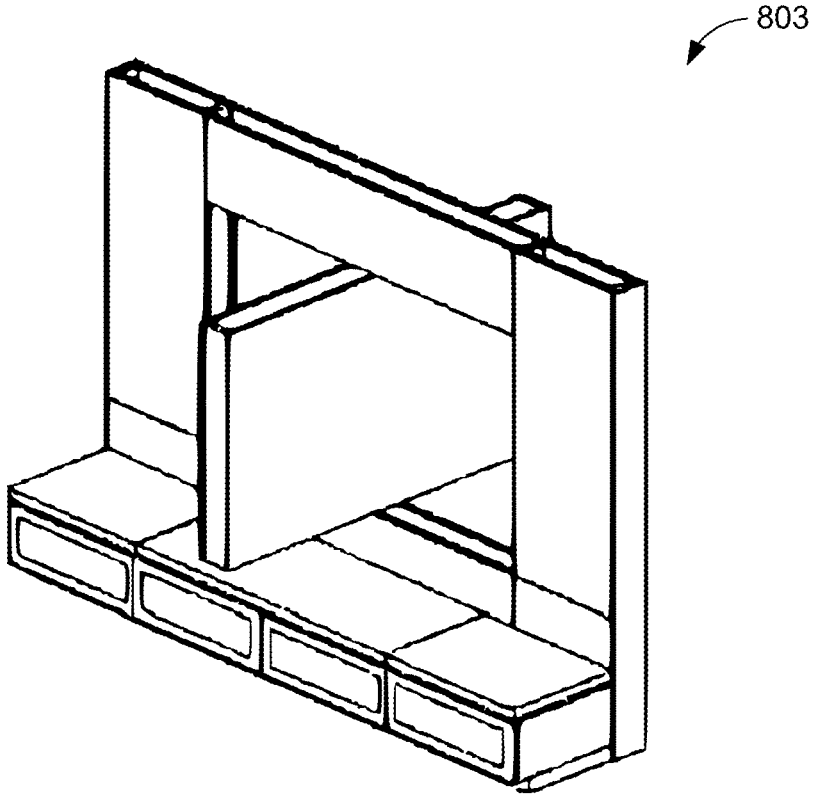
Figure 8D:
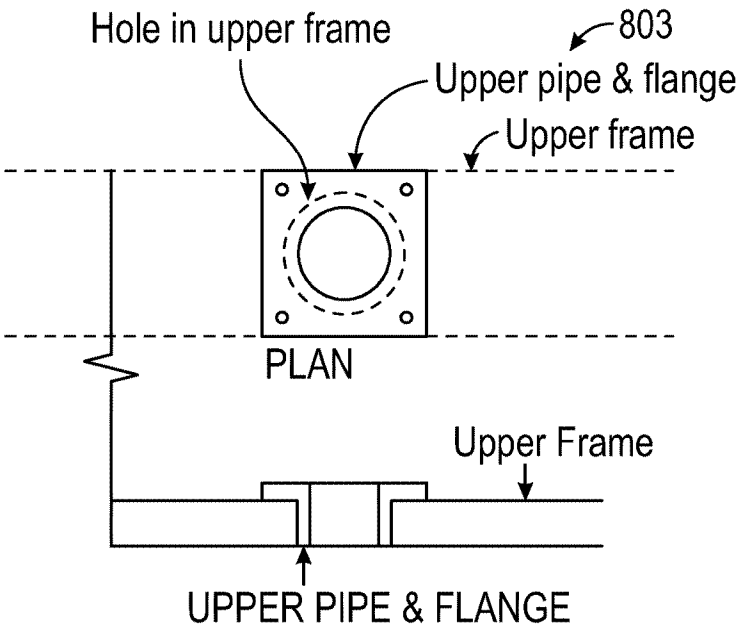
Figure 8C:
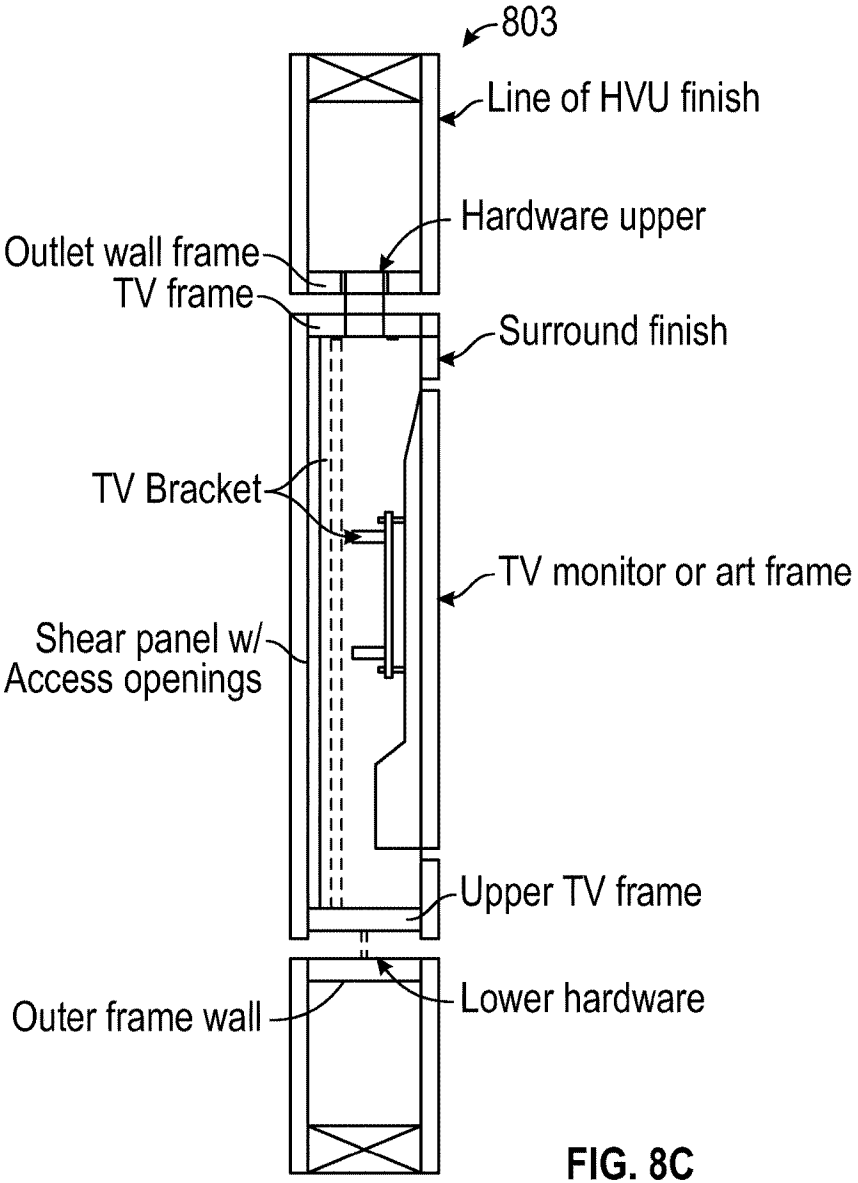
Figure 9A:
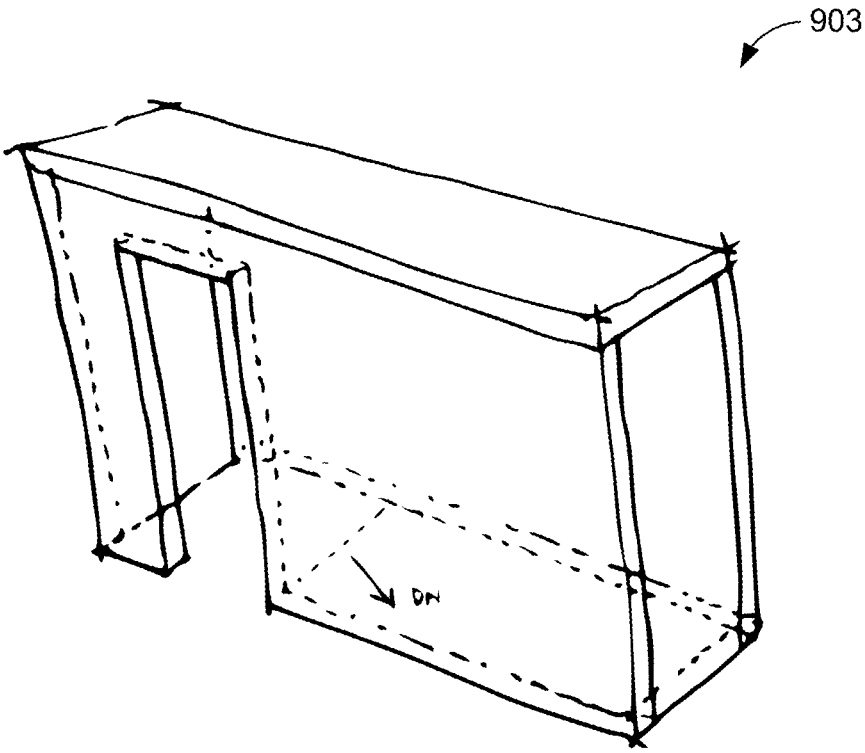
FIGS. 9A and 9B illustrate drawings of a set of stairs cartridges, according to one embodiment described herein.
Figure 9B:
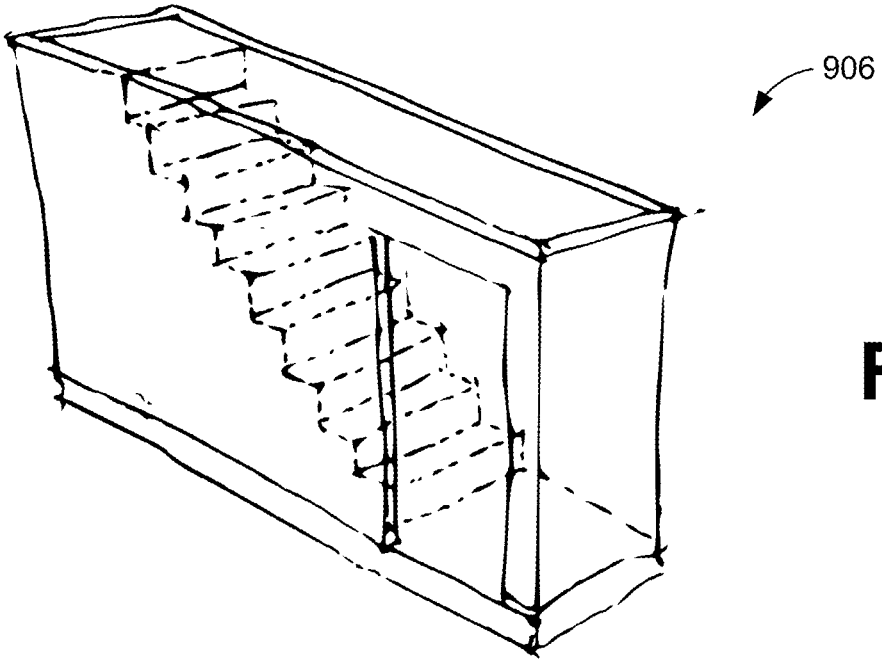

In some examples, the media frame assembly 803 can include a central frame that allows the display 435 (FIG. 4I) or a partition within the wall to spin 360 degrees (FIG. 8B). The media frame assembly 803 can come in a range of sizes to accommodate different size TVs, monitors, or art. The media cartridge 122 can include structural hardware, such as brackets, frames (can be ordered to custom size or to fit a selected monitor), and other suitable components. The hardware that carries the media frame assembly 803 allowing it to spin can include upper and lower components. The upper component consists of two sleeved hollow pipes that nest within each other. The hollow pipe allows the power cord to pass from the inside frame to the exterior frame. An incorporated power swivel keeps the cord from twisting and binding. Each short pipe has a flange for connecting the pipe to the two adjacent frames. The lower hardware components include a socket and a bearing, one attached to the upper frame and the other to the lower frame. To insert the inner frame TV wall into the opening of the main wall, one would begin by tilting the bearing of the lower frame into the socket of the lower frame (or vice versa) and tilting the frame to align the hole in the inner frame with the hole in the upper frame and inserting the sleeve pipe into the upper sleeve. The flange is then screwed into the TV frame to secure Next, FIGS. 9A and 9B illustrate drawings of a top stairs cartridge 903 and a base stairs cartridge 906. To support two or more level structures, single floor stair cartridges 903, 906 can stack on each other and adjacent to the home. Each cartridge contains the run of stairs needed to reach the top layer. Two types of cartridges are needed, a base stair cartridge 906 (with the steps) and a top stairs cartridge 903 for enclosure.

The stair units 903, 906 can come complete with building enclosure and infrastructure including structural walls, insulation, interior finishes, electrical, lighting, and any smart related electronics. Steps are also prefinished. Accessibility equipment can also be pre-installed such as chair lifts or residential elevators.

Disjunctive language such as the phrase "at least one of X, Y, or Z," unless specifically stated otherwise, is otherwise understood with the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

Therefore, the following is claimed:

1. A building structure, comprising:

a systems cartridge that is configured to provide a flow of conditioned air for the building structure and to operate as an electrical power source for the building structure;

a plumbing cartridge that is configured to provide a flow of water for the building structure;

a spine cartridge that is configured to be attached to the systems cartridge and the plumbing cartridge, the spine cartridge comprising an electrical conduit for providing power from the systems cartridge to a plurality of electrical access points in the building structure, an air duct conduit for providing the flow of conditioned air from the systems cartridge to a plurality of air duct access points in the building structure, and a plumbing conduit for providing the flow of water from the plumbing cartridge to a plurality of plumbing access points in the building structure; and a plurality of movable planar walls that are constructed with at least one of an electrical line, a plumbing pipe, or an air duct, wherein the plurality of movable planar walls are configured to form a portion of a room or a portion of a perimeter of the building structure, wherein the systems cartridge, the plumbing cartridge, and the spine cartridge are prefabricated at a location off-site from the building structure, the systems cartridge and the plumbing cartridge are attached to the spine cartridge at a location on-site of the building structure, and the systems cartridge and the plumbing cartridge have a width of less than about nine feet and a height of less than about thirteen feet.

2. The building structure of claim 1, further comprising: a kitchen cartridge that comprises a cabinet, wherein the kitchen cartridge is attached to the spine cartridge.

3. The building structure of claim 1, wherein the spine cartridge is attached to the plumbing cartridge at a top of or at a bottom of the plumbing cartridge.

4. The building structure of claim 1, wherein the spine cartridge comprises a plurality of recessed perimeter areas.

5. The building structure of claim 1, wherein at least one electrical access point among the plurality of electrical access points comprises an electrical subpanel for a prefabricated cartridge, and the electrical conduit is routed at least to the electrical subpanel for the prefabricated cartridge.

6. The building structure of claim 5, wherein the prefabricated cartridge comprises at least one of a bedroom cartridge, an office cartridge, or a bathroom cartridge.

7. The building structure of claim 1, wherein the systems cartridge comprises at least one floor and at least one wall.

8. The building structure of claim 1, wherein the systems cartridge, the plumbing cartridge, and the spine cartridge are constructed prior to arriving at a building site of the building structure.

9. The building structure of claim 1, further comprising a media cartridge that comprises a display that is configured to pivot at least 180 degrees with respect to a wall for which the display is aligned.

10. The building structure of claim 9, wherein the media cartridge further comprises a plurality of rails that are attached to the wall.

11. The building structure of claim 10, further comprising an actuator that is configured to move the media cartridge along the plurality of rails from a first location in the building structure to a second location in the building structure.

12. The building structure of claim 1, wherein the systems cartridge and the plumbing cartridge have a width of less than about nine feet and a height of less than about twelve feet six inches.

13. The building structure of claim 1, wherein the height is less than about ten feet six inches.

14. The building structure of claim 1, further comprising a computing device that is configured to control an operation of at least one of the systems cartridge, the plumbing cartridge, and one of the plurality of movable planar walls.

15. The building structure of claim 1, further comprising: a prefabricated cartridge that includes:

a floor; and an actuator that is configured to pivot a portion of the floor towards a top of the prefabricated cartridge.

16. The building structure of claim 1, wherein the systems cartridge comprises a heating and ventilation and air conditioning system and an electrical circuit breaker panel.

17. A modular structure, comprising:

a systems cartridge that is configured to provide a plurality of services for the modular structure;

a spine cartridge that is configured to be attached to a top of or a bottom of the systems cartridge, wherein the spine cartridge comprises a plurality of conduits for conveying the plurality of services from the systems cartridge to a plurality of access points in the modular structure; and a plurality of movable planar walls comprising at least one of a pre-plumbed water line, a pre-wired electrical line, a pre-wired network connection line, and a prefixed air duct, wherein the plurality of movable planar walls are configured to form a portion of a room or a portion of a perimeter of the modular structure, wherein the systems cartridge, the planar wall, and the spine cartridge are prefabricated before the systems cartridge is attached to the spine cartridge at an on-site location.

18. The modular residential structure of claim 17, wherein the systems cartridge and the plumbing cartridge have a width of less than about nine feet and a height of less than about thirteen feet.

19. The modular residential structure of claim 18, further comprising: a kitchen cartridge that comprises a cabinet, wherein the kitchen cartridge is attached to the spine cartridge at the on-site location.

20. A method of assembling a modular structure, comprising:

placing a systems cartridge on a foundation, wherein the systems cartridge is configured to provide a plurality of services for the modular structure;

placing a plurality of cartridges on the foundation, wherein the plurality of cartridges comprises at least one of a bedroom cartridge, a kitchen cartridge, a bathroom cartridge, an entry cartridge, and a closet cartridge, wherein at least one of the plurality of cartridges comprise a movable planar wall that is constructed with at least one of an electrical line, a plumbing pipe, or an air duct, and the planar wall is configured to form a portion of a room or a portion of a perimeter of the building structure; and attaching a spine cartridge on top of a portion of the systems cartridge, wherein the spine cartridge comprises a plurality of conduits for conveying the plurality of services from the systems cartridge to a plurality of access points in the modular structure, wherein the systems cartridge, the plurality of cartridges, and the spine cartridge are prefabricated at an off-site location, and the systems cartridge is attached to the spine cartridge at an on-site location for the foundation.

* * * * *